US010203184B2

(12) United States Patent
Klingman et al.

(10) Patent No.: US 10,203,184 B2
(45) Date of Patent: Feb. 12, 2019

(54) PATROL VEHICLE AND PERSONAL PROTECTION SYSTEM

(71) Applicants: Joe Klingman, Snohomish, WA (US); Sandra Higgins, Everett, WA (US)

(72) Inventors: Joe Klingman, Snohomish, WA (US); Sandra Higgins, Everett, WA (US)

( * ) Notice: Subject to any disclaimer, the term of this patent is extended or adjusted under 35 U.S.C. 154(b) by 0 days.

(21) Appl. No.: 15/989,354

(22) Filed: May 25, 2018

(65) Prior Publication Data

US 2018/0340758 A1 Nov. 29, 2018

Related U.S. Application Data

(63) Continuation-in-part of application No. 15/471,423, filed on Mar. 28, 2017, now Pat. No. 9,982,969.

(60) Provisional application No. 62/373,639, filed on Aug. 11, 2016.

(51) Int. Cl.
*F41H 7/00* (2006.01)
*F41H 5/26* (2006.01)
*F41H 5/08* (2006.01)

(52) U.S. Cl.
CPC ..... *F41H 5/263* (2013.01); *F41H 5/08* (2013.01)

(58) Field of Classification Search
CPC ..... F41H 5/263; F41H 7/00; F41H 5/26
USPC ..... 89/36.07, 36.09; 296/146.1
See application file for complete search history.

(56) References Cited

U.S. PATENT DOCUMENTS

2015/0114533 A1* 4/2015 Peries ..... B60J 11/08 150/168
2015/0268009 A1* 9/2015 Tunis, III ..... B43L 1/00 89/36.02

* cited by examiner

*Primary Examiner* — J. Woodrow Eldred
(74) *Attorney, Agent, or Firm* — Dean A. Craine, P.S.

(57) ABSTRACT

A patrol vehicle protection system with a quick release bullet resistant transparent panel system that requires no permanent modifications to the patrol vehicle, offers head impact safety protection, and may be used as a handheld protective shield. The system includes a bullet resistant transparent panel that temporarily attaches to a mounting mechanism mounted inside the door window opening. The mechanism includes upper and lower brackets that engage the window tracks around the door window opening. An optional vertical brace may be used to hold the brackets in place. The transparent panel is securely held between the two brackets with magnets that allow release of the panel in a side impact collision. The system includes at lateral force generating device mounted to a bracket that is activated when a side impact is detected forcing the transparent panel outward. The system also includes a quick release handle configured to be selectively attached to the transparent panel enabling to be removed and used as a protective shield.

19 Claims, 27 Drawing Sheets

PATROL VEHICLE AND PERSONAL PROTECTION SYSTEM

This is a continuation in part application of U.S. utility patent application (application Ser. No. 15/471,423) filed on Mar. 28, 2017 which was based on and claimed the filing date benefit of U.S. provisional patent application (Application No. 62/373,639), filed on Aug. 11, 2016.

Notice is given that this patent document contains original material subject to copyright protection. The copyright owner has no objection to the facsimile or digital download reproduction of all or part of the patent document, but otherwise reserves all copyrights.

BACKGROUND OF THE INVENTION

1. Field of the Invention

This invention pertains to ballistic-resistant protection systems for police officers, and more particularly, to bullet-resistant protection systems for patrol vehicles that can be easily attached or removed from the patrol vehicle and includes a transparent panel that automatically releases from the vehicle's window opening in a side impact collision and can be selectively removed from the window opening and used as a personal, hand-carried protection shield.

2. Description of the Related Art

Patrol vehicles rarely have bullet-resistant windows and doors to protect the police officers from being shot while sitting in the patrol vehicle. Unfortunately, the cost to purchase and install bullet-resistant windows and doors in a patrol vehicle and then remove them from the patrol vehicle when the patrol vehicle is sold to the public is too expensive for some municipalities. Further, ballistic resistant window systems found in the prior art creates a safety risk for the occupants as one's head may impact the ballistic glass. Because bullet-resistant windows are thicker and have greater mass, head injuries are more serious in a side impact accident in patrol vehicles with such windows.

Sometimes, a police officer assigned to a patrol vehicle must leave the patrol vehicle. Because they may be shot or struck with rocks or other objects when outside the patrol vehicle, easy access to a lightweight, portable, bullet-resistant, protection shield they may use when outside the patrol vehicle would be desirable.

What is needed is a bullet-resistant protection system for a patrol vehicle that protects the head, upper torso, arms and legs of a driver and a passenger sitting in the patrol vehicle that can be easily installed and removed from the patrol vehicle and also does not require expensive modification to the patrol vehicle. What is needed is a system that uses a transparent panel made of ballistic-rated material that fits into the patrol vehicle's door window opening that automatically releases outward from the door window opening when the patrol vehicle experiences a rapid lateral change in velocity, such as may occur in a side impact collision. What is also needed is a system in which the transparent panel that can be easily and quickly disconnected from the patrol vehicle and used as a hand-held protection shield.

SUMMARY OF THE INVENTION

At the heart of the invention is the discovery of the need for an inexpensive, easy to install and easy to remove bullet-resistant protection system for a patrol vehicle that protects the head, upper torso, arms of a driver or passenger sitting in the front seat of the patrol vehicle. Also, at the heart of the invention is the discovery of the need for a ballistic-rated transparent panel that automatically releases outward from the door window opening when the patrol vehicle experiences a rapid lateral change in velocity such as may occur in a side impact collision. Also, such a system is needed that allows the driver to adjust the system to provide additional protection to his or her lower torso and legs when sitting in the patrol vehicle. Also, such a system is needed that includes a quick release feature that allows the driver to remove the transparent panel from the door window opening when the window is rolled down and used as a hand-held protection shield.

The system includes a ballistic-rated transparent panel that temporarily attaches to the patrol vehicle's door window opening. During installation, the door window is lowered into the door and the system's window opening mounting mechanism is installed on the door frame around the door window opening. The mounting mechanism is configured to securely hold the transparent panel in the door window opening and still allow the existing door window to be opened or closed.

The mounting mechanism includes an upper bracket and a lower bracket. The upper and lower brackets each include flange surfaces designed to fit into the window tracks formed on the upper and lower edges of the door frame surround the door window opening. The mounting mechanism may include a vertical brace is configured to extend between the upper and lower brackets and hold them apart and press them into the window tracks. The vertical brace is relatively long and narrow and may be made of transparent, durable polycarbonate, glass, or acrylic material (or a combination thereof). The vertical brace may include openings that reduce weight and/or further improve visibility. In some embodiments, the vertical brace is eliminated, and the upper bracket and the lower bracket are affixed to the door frame surround the door window opening with threaded connectors.

A plurality of connecting elements are disposed between the transparent panel and the upper and lower brackets that temporarily hold the transparent panel in place against the intermediate flanges on the upper and lower brackets. In one embodiment, the connecting elements are magnets attached to the upper and lower edges of the transparent panel. The magnets on the transparent panel are magnetically attracted directly to the brackets when made of metallic ferrous material. If the brackets are not made of metallic ferrous material, then pates made of ferrous material may be attached to the brackets that are magnetically attracted to the magnets. It should be understood that a reverse orientation may be used in which the magnets are attached to the brackets and ferrous plates or strips are attached to the edges of the transparent panel. In all the magnet-based embodiments, the magnets generate enough attractive force to hold the transparent panel over the door window opening and still allow the transparent panel to release outward from the door window opening when the patrol vehicle undergoes lateral acceleration over 3 mph in under 200 milliseconds or similar such forces experienced in a side impact collision.

By using a plurality of connecting elements between the transparent panel and the upper and lower brackets during a side impact collision, the transparent panel will automatically detach and move outward from the door window opening thereby reducing head injuries.

In other embodiments, the connecting elements may be L-shaped breakable clips, loop and hoop connectors, or rotating break-away tabs attached to the brackets that hold the transparent panel in place on the brackets and allow release in a side impact collision.

In another embodiment, one or more lateral force generating devices are attached to the inside surface on the inside flange on one or more brackets. In one embodiment, the lateral force generating device is a pyrotechnic device. When a lateral impact on the motor vehicle is detected by a sensor, the lateral force generating device is activated forcing the transparent panel outward thereby mitigating head injuries. The sensor may be the patrol vehicle's airbag control module or a separate sensor that connects to the vehicle's airbag control module or to the vehicle's OBDII port.

The transparent panel may include an optional handle that mounts to the transparent panel's outside surface. In one embodiment, the transparent panel includes holes that receive two pegs attach to a handle. In another embodiment, the handle includes a quick attachment and release feature that allows the patrol officer to quickly attach the handle to the transparent panel. The quick attachment and release feature includes two pegs formed on the handle that extend through the transparent panel. The pegs have retractable pins on their distal ends that are biased outward to securely hold the handle on the transparent panel. When the window is rolled down, the police officer can insert the pegs into the transparent panel and then pull on the handle to manually remove the transparent panel from the vehicle's window opening and use the transparent panel as a protective shield. By manually pressing the pin inward, the pegs can be easily removed from the transparent panel.

In addition, the system includes a carrying case used to store and transport the transparent panel. The case is made of two complimentary-shaped leaves. The case may include a ballistic fabric panel which acts as a ballistic barrier when the case is hung over the inside surface of the vehicle door. The case may include connectors that attach to the lower bracket when installed on the door. The ballistic fabric panel has a suitable shape and size so when hung vertically over the inside surface of the door, the driver's or passenger's lower torso and legs are protected when sitting in the patrol vehicle.

DESCRIPTION OF THE DRAWINGS

33 with the vertical brace and the lower bracket removed and shows the relative location of the pyrotechnic device

DESCRIPTION OF THE PREFERRED EMBODIMENT(S)

Figure 1:
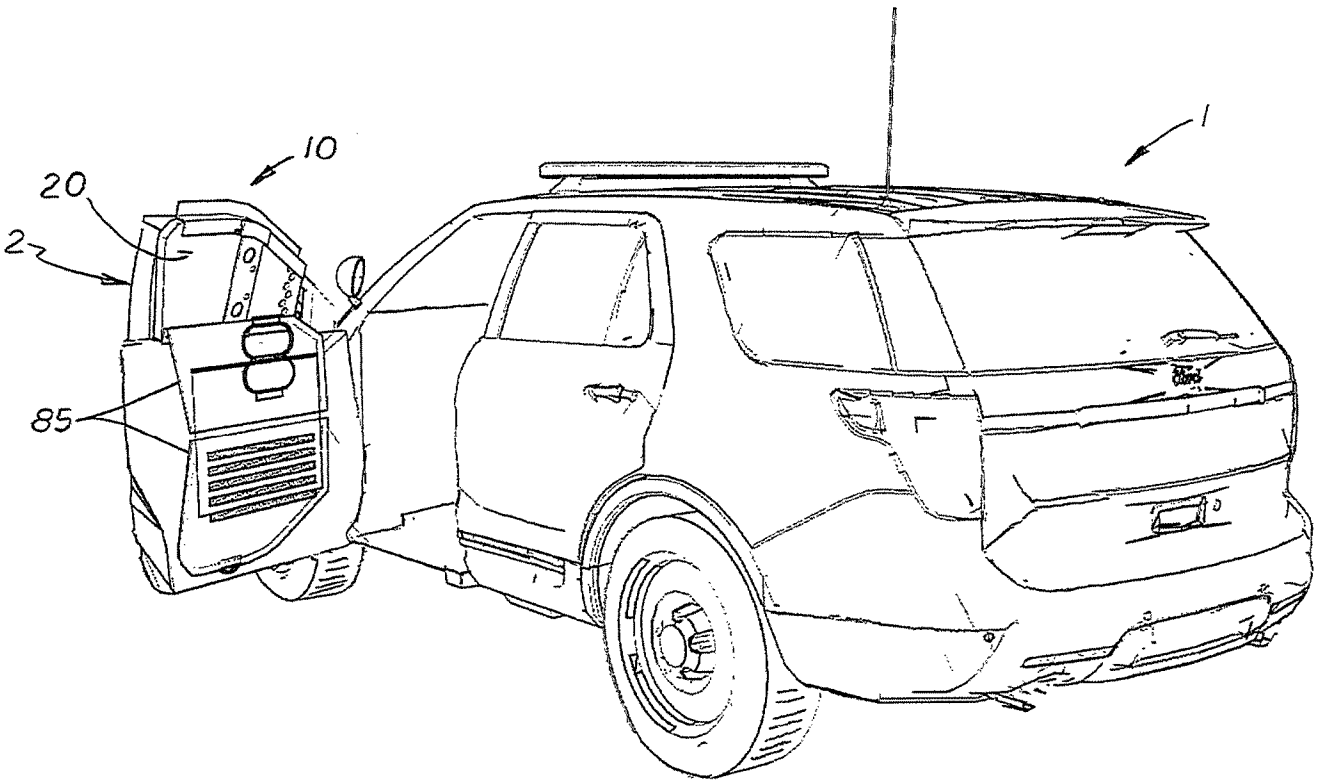
FIG. 1 is a rear perspective view of the patrol vehicle system attached to a door of a patrol vehicle.

A patrol vehicle protection system 10 is provided with a quick release ballistic-rated transparent panel 20 and door panel covering system that provides head, upper torso, lower torso, and leg protection and head impact safety protection to a patrol officer sitting in a patrol vehicle. The system 10 includes a ballistic-rated transparent panel 20 that temporarily extends entirely or partially attaches over an existing door window opening 5 using an easy-to-attach door window opening mounting mechanism 25. In one embodiment, the system 10 is described being installed on one vehicle door 2. It should be understood, however, that the system 10 may be used on two or more vehicle doors. It should be understood the system 10 may be installed on either the front doors or the rear doors on a patrol vehicle.

The ballistic-resistant transparent panel 20 is made of polycarbonate, glass, acrylic, or newer materials such as those made by scientists at Surmet, a company that develops a transparent polycrystalline called ALON Optical Ceramic (commonly called 'Transparent Aluminum', or aluminum nitride or a combination thereof, and configured to fit into the vehicle door window opening 5. The transparent panel 20 has enough length and width to fit inside the door window opening 5. When made of polycarbonate, glass or acrylic, the transparent panel 20 is between approximately ½ to 4½ inches thick depending on the needed level of protection. When the transparent panel 20 is made of ALON it may be made ¼ to 2 inches thick. Transparent panels 20 made of polycarbonate ballistic-related materials are available from Bayer Science of Leverkusen, Fed. Rep. Germany and sold under the trademark MAKROLON or from Covestro, LLC, of Pittsburgh, Pa. and sold under the trademark HYGARD.

The transparent panel 20 is held inside the door window opening 5 by a door window mounting mechanism 25 that includes upper and lower brackets 32, and 42 described further below by connecting elements. In one embodiment, the connecting elements include a plurality of magnets 22, 24. In the embodiment shown in the Figs., the transparent panel 20 includes at least one inward facing upper magnet 22 and two inward facing lower magnets 24 evenly spaced apart and configured to be magnetically attracted to complimentary-shaped magnets 120, 122 attached to the inside surface of the upper and lower brackets 32, 42, respectively. The magnetic poles on the magnets 22, 120 and 24, 122 are arranged so they attract when in close proximity.

The mounting mechanism 25 may also include a length adjustable vertical brace 58. In the first embodiment, the vertical brace 58 comprises two longitudinally aligned metal plates 60, 70 each attached at one end to an upper and lower bracket 32, 42, respectively. The opposite ends of the two plates 60, 70 overlap and are selectively attached and extended vertically over the inside area in the door window opening 5. By adjusting the overlap areas on the adjustable plates 60, 70, the overall length of the vertical brace 58 may be adjusted to fit different size window openings 5. In one embodiment, the vertical brace 58 is made of polycarbonate or plastic and is of a fixed length.

The upper bracket 32 is Z-shaped in cross-section with an inner flange surface 34, an intermediate flange surface 36 and an outer flange surface 38. The outer flange surface 38 is configured to be inserted into the upper window track 6 formed on the upper door frame surrounding the door window opening 5. Formed on the inside surface of the inner flange surface 34 are a plurality of parallel slots 35 configured to receive ribs 62, 72 formed on an upper clamp 120, discussed further below.

The lower bracket 42 is also Z-shaped in cross-section and includes an inner flange surface 44, an intermediate flange surface 46 and an outer flange surface 48. The outer flange surface 48 extends downward on the lower bracket 42 and configured to be inserted into the lower window track 8 formed on the lower inside edge of the existing door window opening 5. Formed on the inside surface of the inside flange surface 44 are a plurality of parallel slots 49 configured to receive rib 62, 72 formed on a lower clamp 130 also discussed further below.

Figure 10:
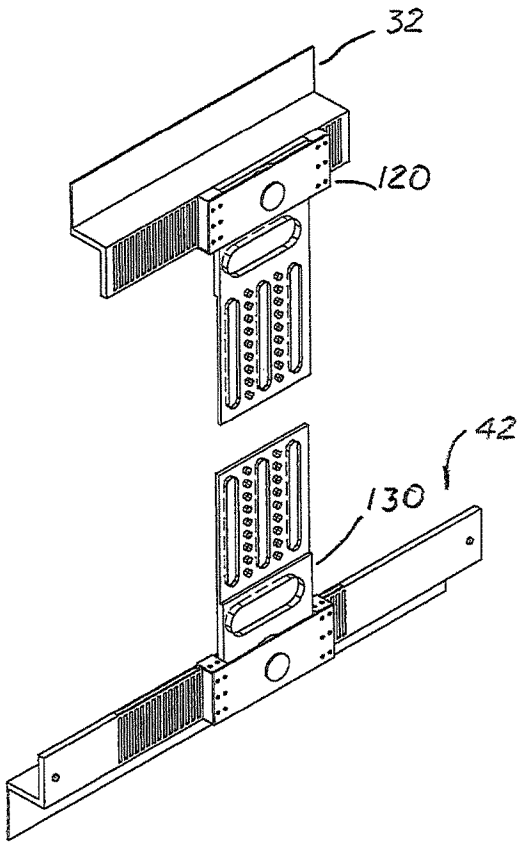
FIG. 10 is a partially exploded view of the upper and lower brackets both attached to a half adjustment plate and showing the upper and lower clamps attached from the two brackets.
Figure 9:
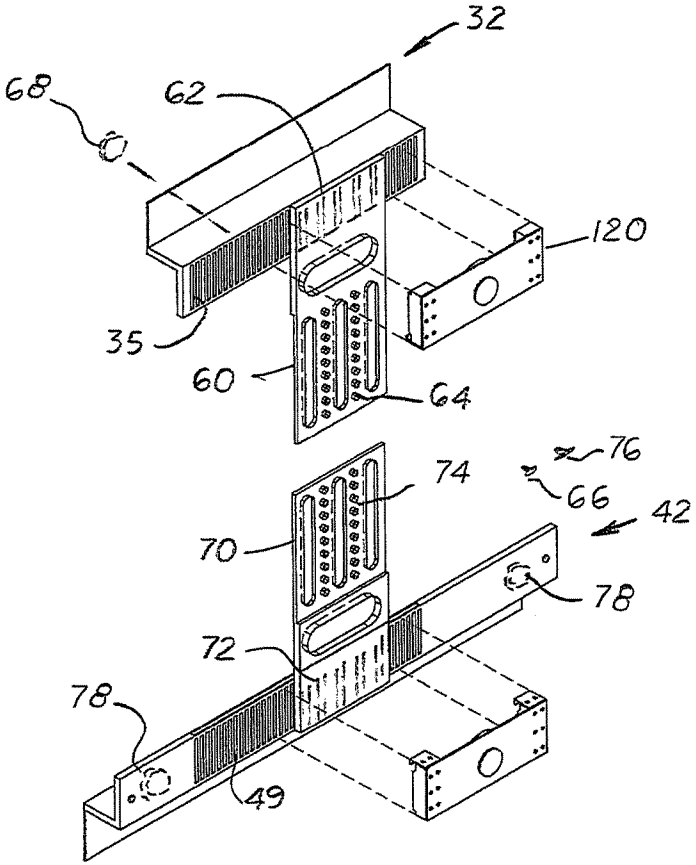
FIG. 9 is an exploded view of the upper and lower brackets both attached to a half adjustment plate that form a length adjustable vertical brace and showing upper and lower clamps detached from the brackets.

As shown in FIGS. 9 and 10, the two adjustable plates 60, 70 each include a flat upper and lower surface, a handle hole, and three parallel rows of longitudinally aligned mounting holes 64, 74. Formed on the outside surface of each plate 60, 70 is a plurality of longitudinally aligned ribs 62, 72, respectively configured to engage slots 35, 49 formed on the upper and lower brackets 32, 42, respectively. During assembly, the plates 60, 70 are perpendicularly aligned on the upper and lower brackets 32, 42 so the ribs 62, 72 formed on the plates 60, 70 are engaged in the slots 35, 49. The plates 60, 70 are longitudinally aligned so their lower and upper ends overlap and the mounting holes 64, 74, respectively, are aligned and registered. Pegs 66, 76 are then inserted in the mounting holes 64, 74 to connect the ends of the two plates 60, 70 together.

When the brackets 32, 42 are made of steel, the magnets 22, 24 on the transparent panel 20 may be directly connected to the brackets 32, 42. When the brackets 32, 42 are made of non-metallic material, the brackets 32, 42 include magnetically attracted discs 68, 78 magnetically attracted to the magnets 22, 24, respectively, on the inside surface of the transparent panel 20.

Figure 11:
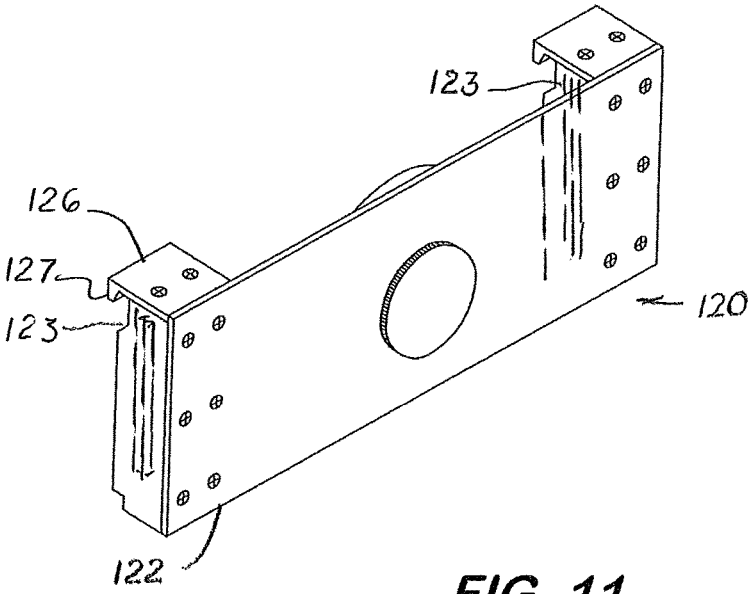
FIG. 11 is a perspective view of the upper clamp.

FIGS. 10 and 11 are perspective views of the upper and lower clamps 120, 130 used to hold the vertical brace 58 on the upper and lower brackets 32, 42. Each clamp 120, 130 includes a rectangular plate 122, 132, and two spacer blocks 124, 134 aligned transversely on the ends of the rectangular plate 122, 132, respectively. Attached to the upper surfaces on the two spacer blocks 124, 134 on the upper clamp 120 are two end caps 126 each with a downward extending lip 137 formed on its distal end. Attached to the lower surfaces on the two spacer blocks 124, 134 on the lower clamp 130 are two end caps 136 each with an upward extending lip formed on its distal end. Attached to the inside surface of spacer blocks 124, 134 are longitudinally aligned ribs 123, 133 configured to engage the slots 35, 49 formed on the inside surfaces of the inside flanges 34, 44 on the upper and lower brackets 32, 42. During assembly, the ribs 125, 135 on the spacer blocks 124, 134 engage slots 35, 49 formed on the upper and lower brackets 32, 42, respectively to hold the clamps 120, 130 in position on the upper and lower brackets 32, 42.

In one embodiment, the upper and lower brackets 32, 42 may be made of metal magnetically attracted to bar magnets attached to the spacer blocks 124, 134 to hold the clamps 120, 130 on the upper bracket 32 and the lower bracket, 42, respectively.

Figure 12:
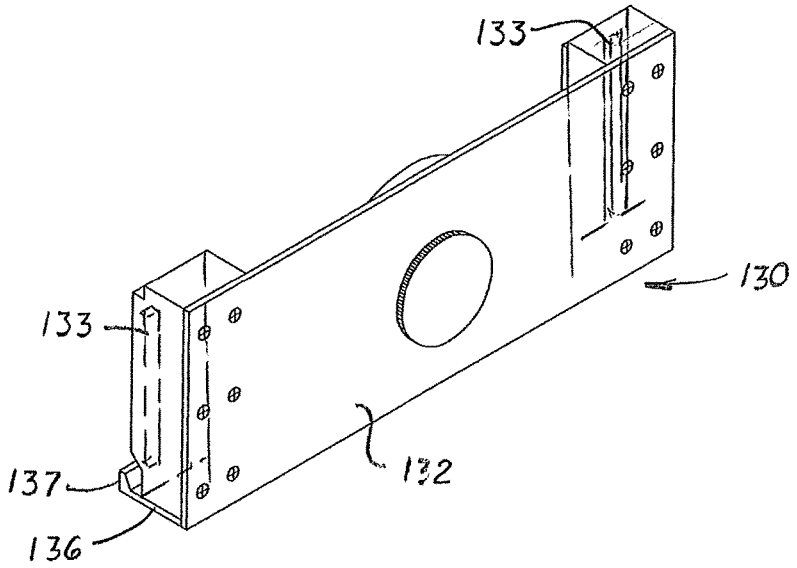
FIG. 12 is a perspective view of the lower clamp.

FIG. 12 is a perspective view of the lower clamp 130 with an optional adjustable pad 140 configured to press against the vertical brace 58 hold the vertical brace 58 and in a fixed position on the upper and lower brackets 32, 42.

Figure 8:
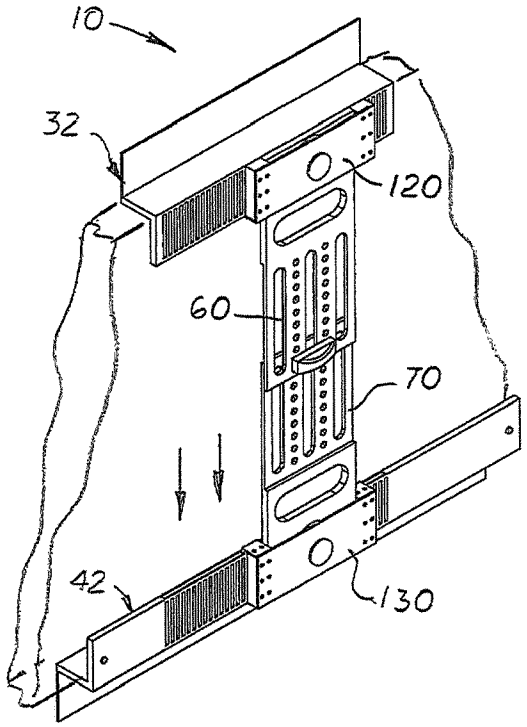
FIGS. 6-8 are rear perspective views of the upper and lower brackets attached to an adjustable vertical brace expanded longitudinally to three possible lengths to accommodate different sizes of door window openings.
Figure 7:
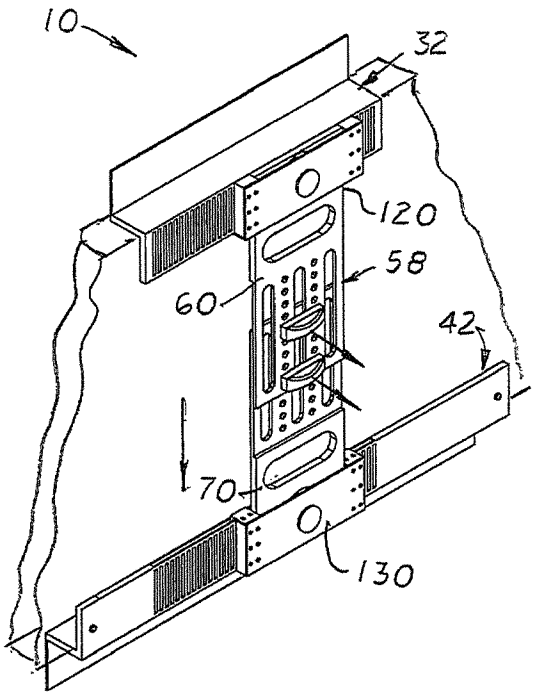
Figure 6:
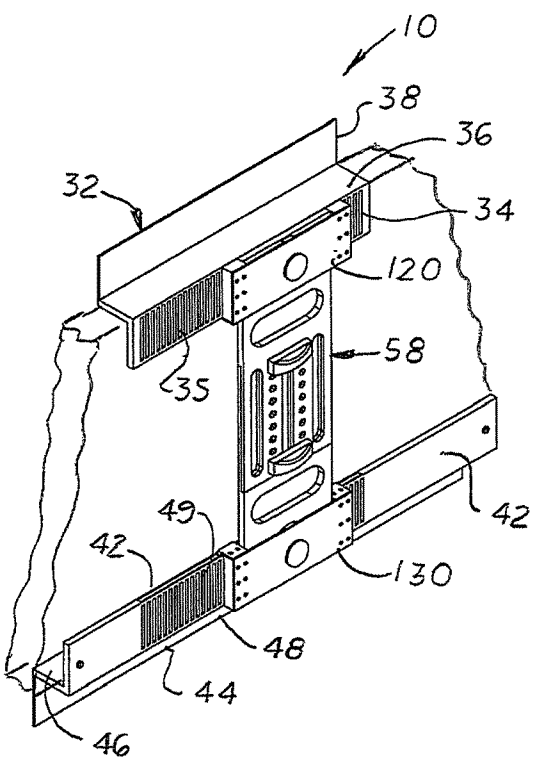
Figure 13:
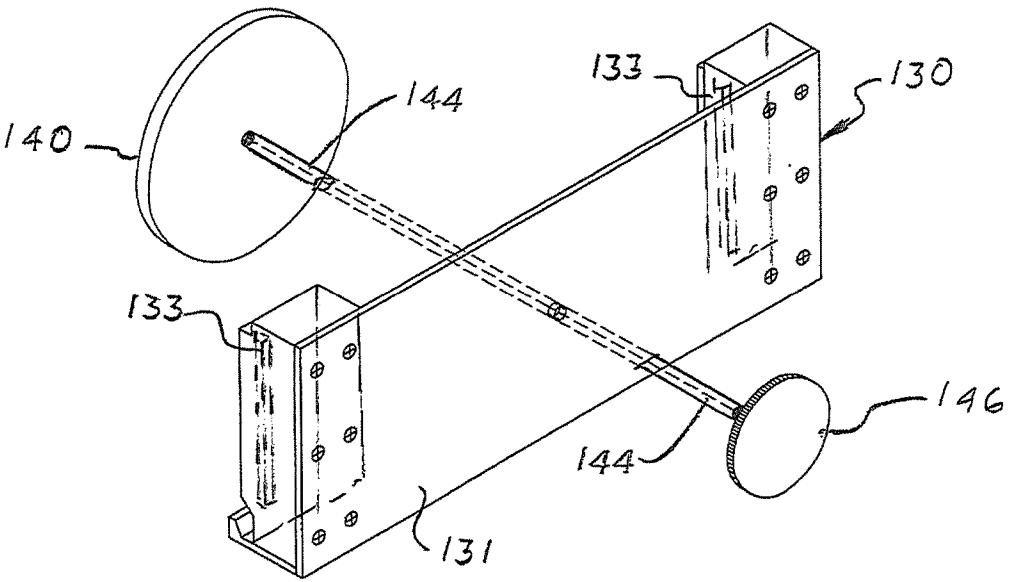
FIG. 13 is a perspective view of the lower clamp with an optional adjustable pad configured to press against the half adjustment plate.
Figure 15:
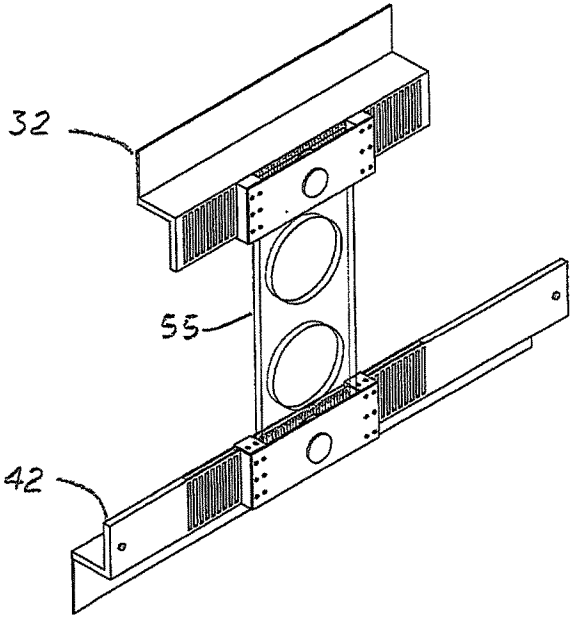
FIGS. 14 and 15 are perspective views of the upper and lower brackets both attached to a fixed-length, vertical brace with an upper clamp and a lower clamp.
Figure 14:
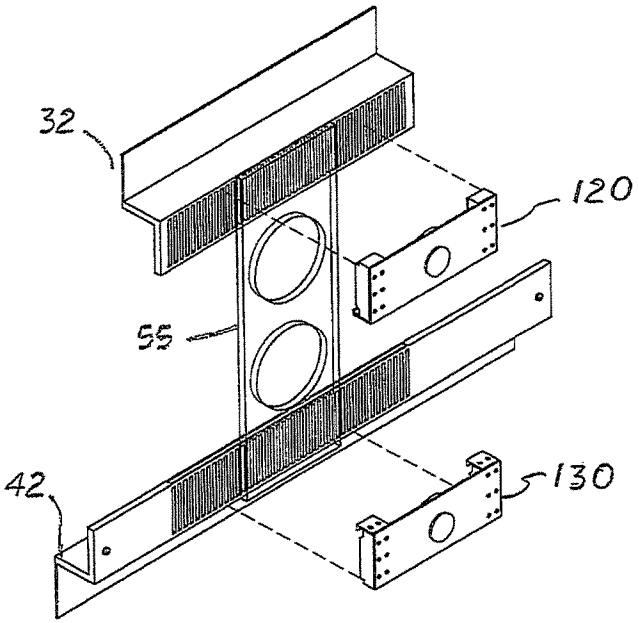

In the first embodiment, the vertical brace 58 is made of two, transparent, polycarbonate adjustment plates 60, 70 as shown in FIGS. 8 and 9. The vertical brace 58 may be made of transparent, polycarbonate material. FIGS. 13 and 14 are perspective views of the upper and lower brackets 32, 42 both attached to a fixed adjustment vertical brace 58.

Figure 2:
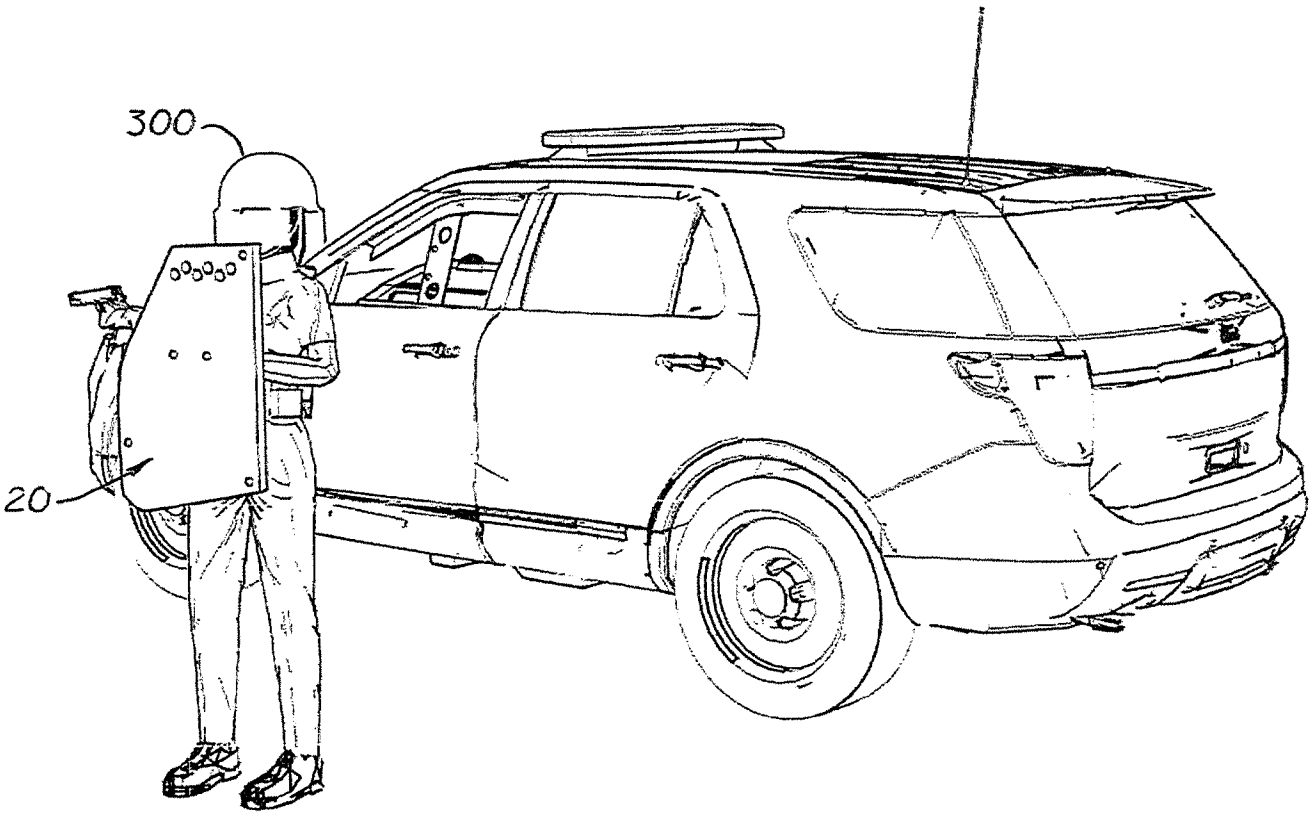
FIG. 2 illustrates a police officer using the system's transparent panel as a hand-held protective shield.

During installation, the vertical brace 58 is attached to the brackets 32, 42 and adjusted in length so the upper and lower brackets 32, 42 are positioned at a desirable location in the door window opening 5. When properly installed, the magnets 22, 24 on the transparent panel 20 are aligned with the brackets 32, 42, or with steel plates or magnets 68, 78 located on the upper and lower brackets 32, 42, respectively. The magnets 22, 24, or 68, 78 hold the transparent panel 20 on the upper and lower brackets 32, 42 but also allows release of the transparent panel 20 from the brackets 32, 42 when the patrol vehicle experiences a rapid lateral change in velocity or when pulled manually the transparent panel 20 from the brackets 32, 42 when used as a personal shield as shown in FIG. 2.

Figure 16:
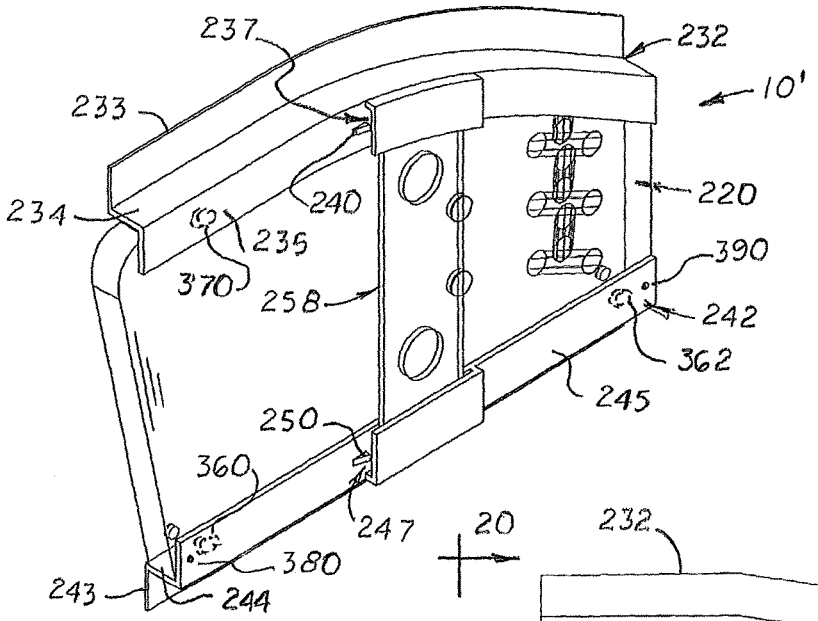
FIG. 16 is a perspective view of a second embodiment of the patrol vehicle protection system that uses a fixed length vertical brace.
Figure 17:
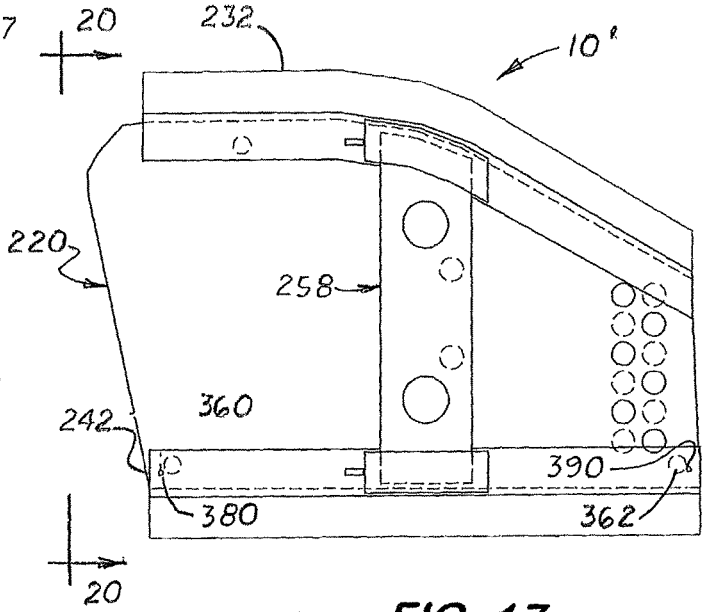
FIG. 17 is a side elevation view of a third embodiment of the system shown in FIG. 16.
Figure 18:
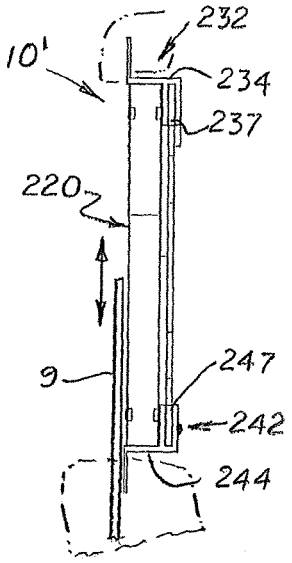
FIG. 18 is an end elevation view of the embodiment shown in FIGS. 16 and 17.

FIGS. 16-18 show a second embodiment of the system 10' that includes a curved, Z-shaped upper bracket 232, a straight, Z-shaped lower bracket 242 and a fixed length vertical brace 258. The upper bracket 232 includes an upper outer flange surface 233, an intermediate flange surface 234 and a lower, inner flange surface 235. Mounted on the inner flange surface 235 near the upper bracket's center axis is a receiver slot 237. The lower bracket 242 includes a lower outer flange surface 243, an intermediate flange surface 244 and an upper inner flange surface 245. Mounted on the inner flange surface 245 near the lower bracket's center axis is a receiver slot 247. The receiver slots 237, 247 are sufficiently wide, substantially parallel, and have a length to accommodate the ends of the transversely aligned vertical brace 258. The forward ends of the receiver slots 237, 247 are closed. Formed or attached to the inside surface of the inner flange surface 235 and on the inner flange surface 235 are diagonal stop lips 240, 250, respectfully, that prevent the vertical brace 258 from sliding rearward from the receiver slots 237, 247.

Formed on the outside surface on the inner flange surface 245 on the lower bracket 242 near its opposite ends are two magnets 360, 362. Formed on the outside surface of the lower flange surface 235 on the upper bracket 232 near the rear end of the upper bracket 232 is a single magnet 370. Also formed on the lower bracket 242 near the opposite ends are snap or hook or loop connectors 380, 390.

As shown in FIG. 18, the width of each intermediate flange surface 234 or 244 is sufficient so a transparent panel 20' may be fit over the intermediate flange surfaces 234, 244. When attached to the mounting mechanism, the window glass 9 may still be selectively lowered or raised.

Figure 19:
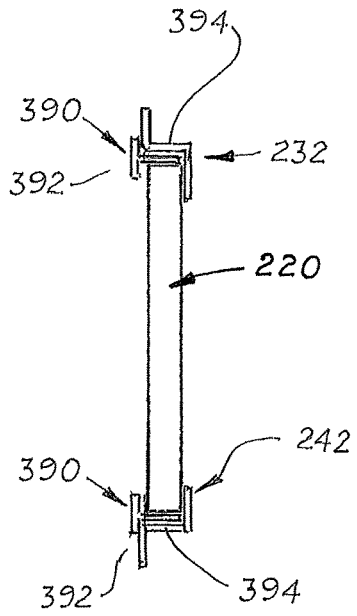
FIG. 19 is an end elevational view of the upper and lower brackets surrounding a transparent panel with T-shaped clips being inserted into a slot formed on the lower bracket that holds the lower edge of the transparent panel in place on the lower bracket.
Figure 20:
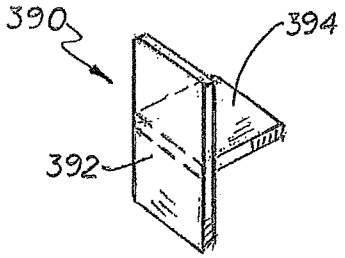
FIG. 20 is a perspective view of a T-shaped clip shown in FIG. 19.

The magnets 22, 24 hold the transparent panel 20' in place on the brackets 232, 242 in normal driving conditions. In a side impact collision, the transparent panel 220 detaches from the brackets 232, 242. Besides using magnets 22, 24, FIGS. 19 and 20 show T-shaped clips 390 mounted in-between the intermediate flanges 234, 244 on the upper bracket 232 and lower bracket 242, respectively, and the top and lower edges of the transparent panel 220. Each clip 390 includes an outer leg 392 and a perpendicularly aligned intermediate leg 394. During use, the intermediate leg 394 is inserted into the gap formed between the upper and lower brackets 232, 242 and the top and bottom edges of the transparent panel 220. The clips 390 are configured to exert enough pressure to hold the transparent panel 220 in place but allow the transparent panel 220 to detach in a side impact collision or if manually pulled outward by the patrol officer to use the transparent panel 220 as a protective shield.

Figure 21:
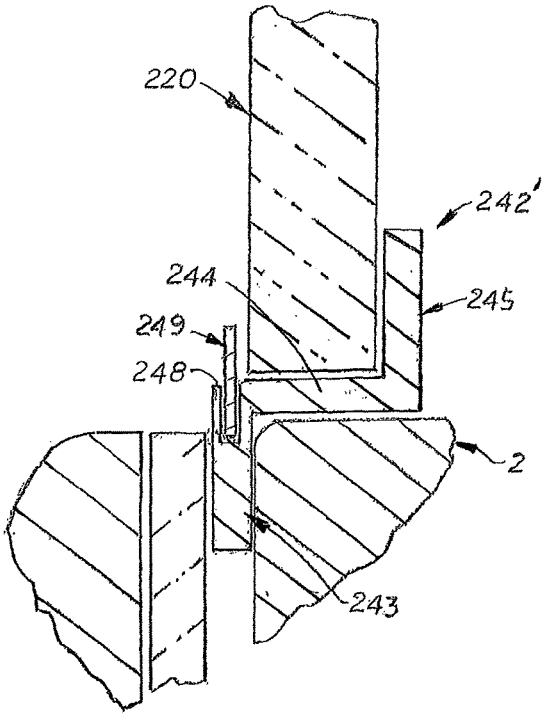
FIG. 21 is an upper, sectional view of a door showing a modified z-shaped lower bracket with a longitudinally aligned slot formed on the intermediate flange parallel with the inside flange and that receives a straight tab configured to break apart when the transparent panel moves outward during a side impact collision.

FIG. 21 is an upper, sectional view of a door showing a modified z-shaped lower bracket 242' used with a transparent panel 220. The lower bracket 242' includes a longitudinally aligned slot 248 formed on it intermediate flange 244 that is parallel to its inside flange 245. During use, the slot 248 receives a straight break-away tab 249 configured to break apart when the transparent panel 220 moves outward during a side impact collision or manually pulled by the police officer.

Figure 22:
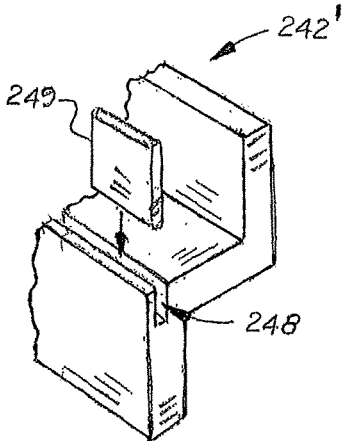
FIG. 22 is a perspective of the lower bracket and tab shown in FIG. 21.

FIG. 22 is a perspective of the lower bracket 242' and tab 249 shown in FIG. 21. It should be understood that when upper bracket 242 can be modified in the same manner as 242' and used with a tab 249.

Figure 23:
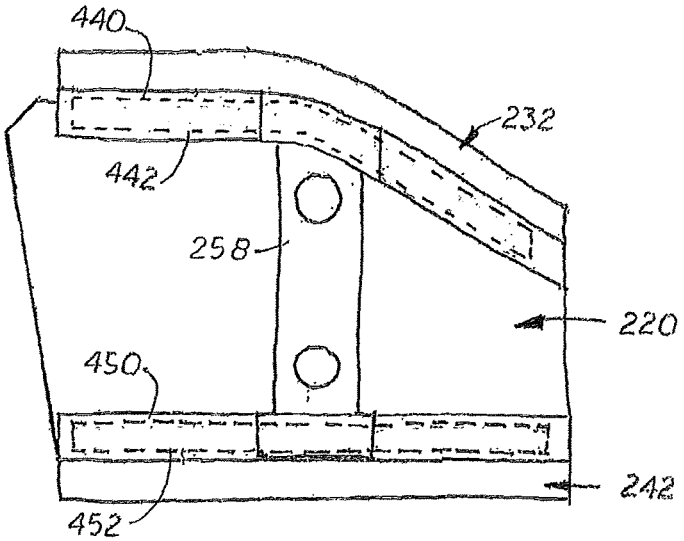
FIG. 23 is a side elevational view an upper bracket, a lower bracket, a vertical brace and a transparent panel mounted on the upper and lower brackets shown in FIG. 16 but with strips of hook and loop connector material attached to the inside surface of the upper and lower flanges on the upper and lower brackets, respectively.

FIG. 23 is a side elevational view an upper bracket 232, a lower bracket 242, a fixed length vertical brace 258 and a transparent panel 220 mounted on the upper and lower brackets 232, 242 by strips of hook and loop connector material, 440, 442 and 450, 452, attached to the inside surface of the upper and lower flanges on the upper bracket 232 and lower bracket 242, respectively.

Figure 24:
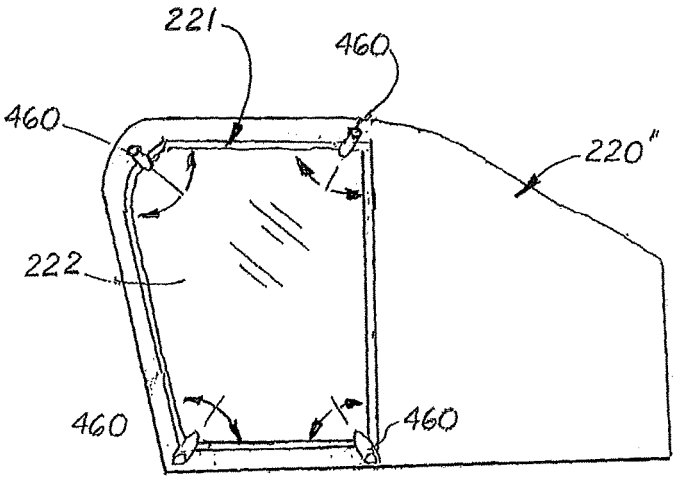
FIG. 24 is a side elevational view of a modified transparent panel with a small window opening formed therein that receives a small transparent panel held inside the window opening by four rotating clips.

FIG. 24 is a side elevational view of a modified transparent panel 220' with a small window opening 221 formed therein that receives a small transparent panel 221 held inside the window opening 221 by four rotating clips 460.

Figure 3:
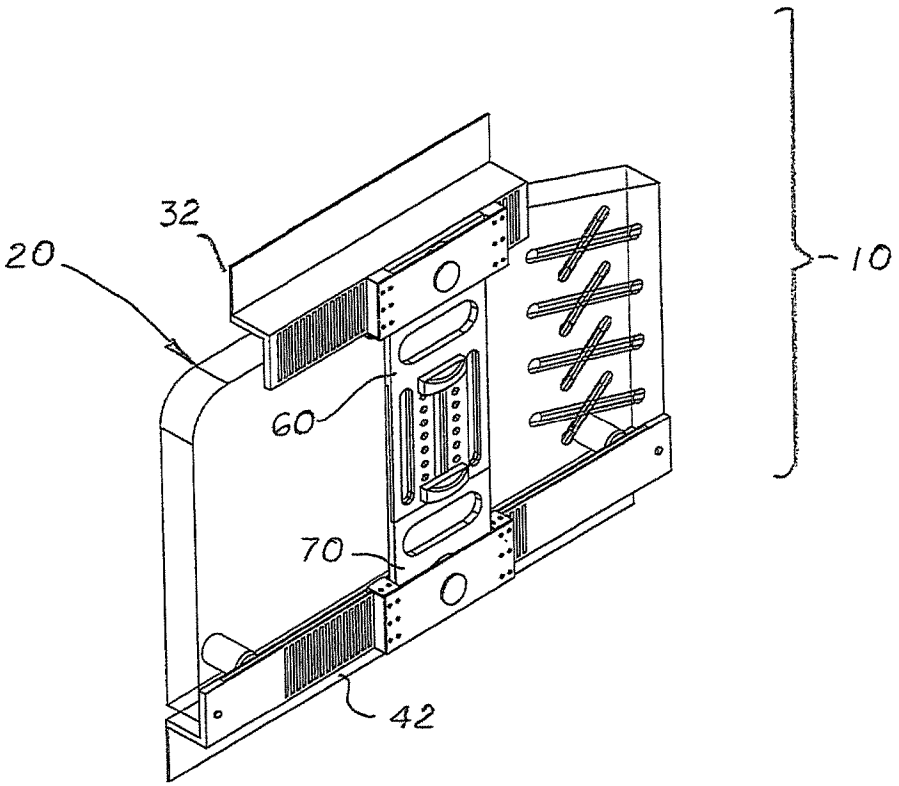
FIG. 3 is a front perspective view of one embodiment of the system.
Figure 5:
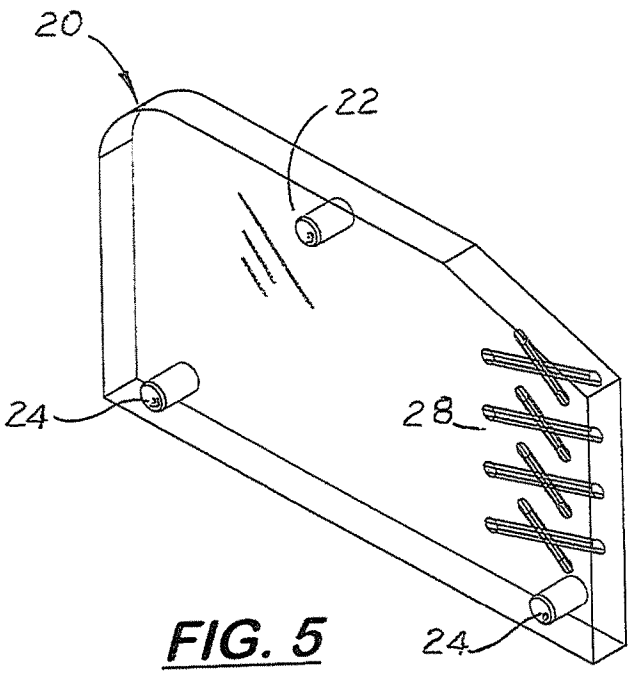
FIG. 5 is a front perspective view of the transparent panel.
Figure 4:
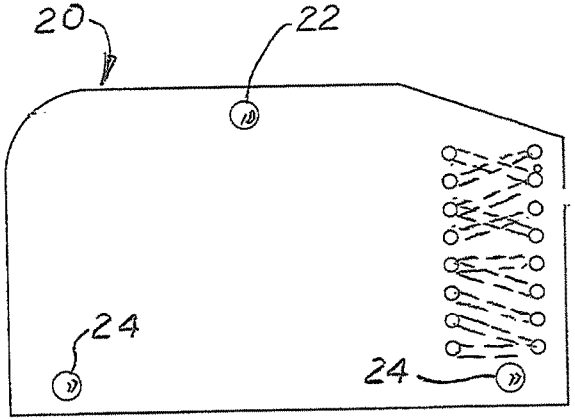
FIG. 4 is a side elevational view of the transparent panel.
Figure 26:
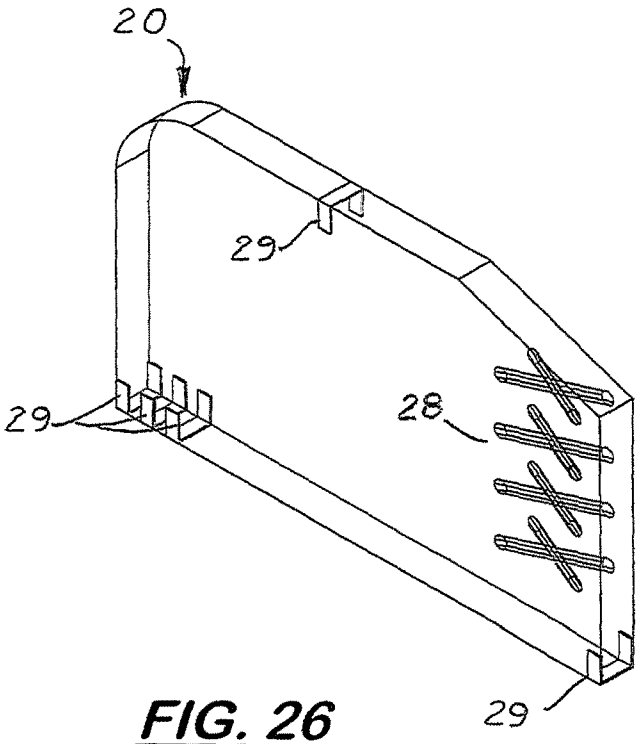
FIGS. 25 and 26 are a side elevational view and a front perspective view, respectively, of an alternative transparent panel that uses five magnetic clips in place of three magnets shown in FIGS. 4 and 5.
Figure 25:
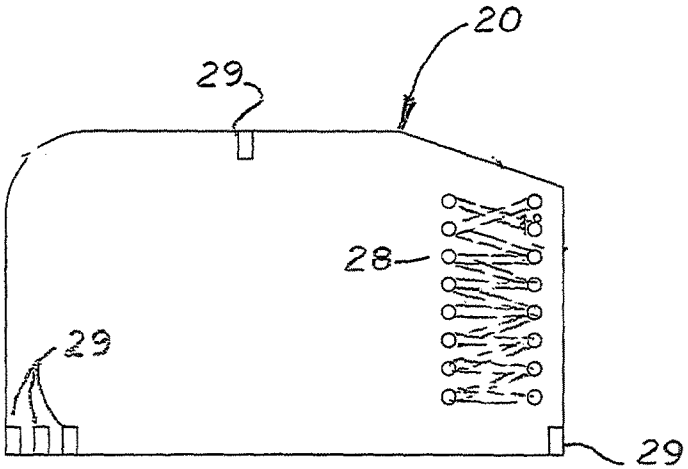

FIGS. 25 and 26 is a side elevational view and front perspective view, respectively, showing an alternative transparent panel 220 that uses five magnetic clips 29 used in place of two magnets 22 and 24 used in the transparent panel 20 shown in FIGS. 3 and 4.

Figure 27:
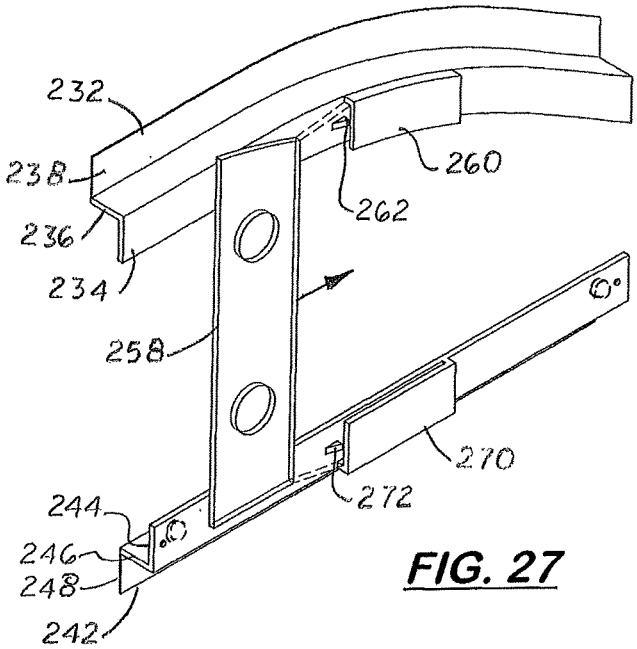
FIG. 27 is a perspective view of the upper and lower brackets that includes stops and slotted holder formed on the inside surface of the upper and lower brackets that captures the ends of the vertical brace.

FIG. 27 is a perspective view of the embodiment of the mounting system that shows the vertical brace 258 sliding over optional stops 262, 272 used with the slotted receivers 260, 270 formed on the upper bracket 232 and lower bracket 242, respectively, to hold the vertical brace 258 inside the slotted receivers 260, 270.

Figure 28:
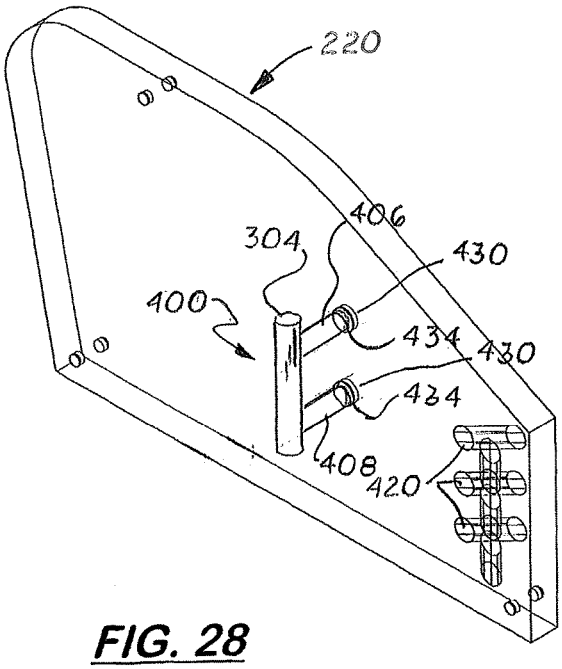
FIG. 28 is a perspective view of the transparent panel used in the embodiment shown in FIG. 24 with a removable, external handle attached to the transparent panel.

FIG. 28 is a perspective view of the transparent panel 220 used in the embodiment shown in FIG. 25 with an optional external handle 400 selectively or permanently attached to the transparent panel 220. Transparent panel 20' may include ventilation holes 420 and handle holes 430. In one embodiment, the handle holes 430 are closed with magnets 434 located therein that connect to the legs 406, 408 on a handle 400.

Figure 29:
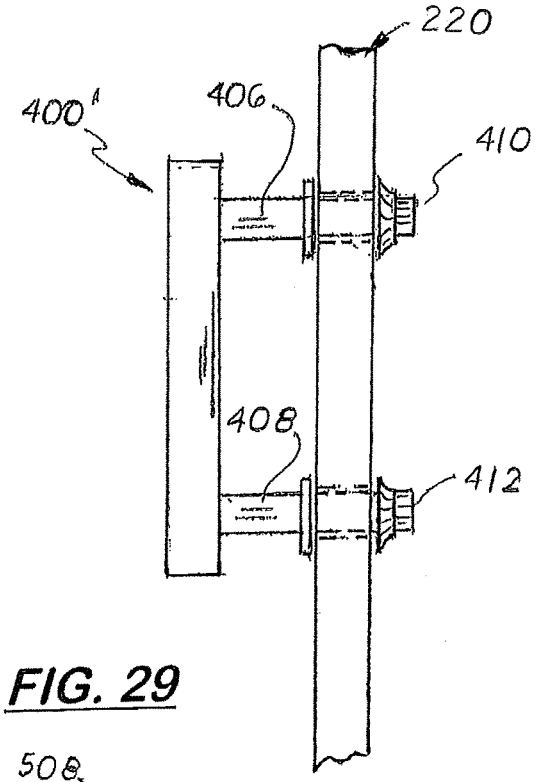
FIG. 29 is a side elevational view of the transparent panel with a fixed handle.

FIG. 29 is a side elevational view of the transparent panel 220 with a non-removable handle 400' with long legs 406, 408 that extend through the transparent panel 220 and held in place with end connectors 410, 412.

Figure 30:
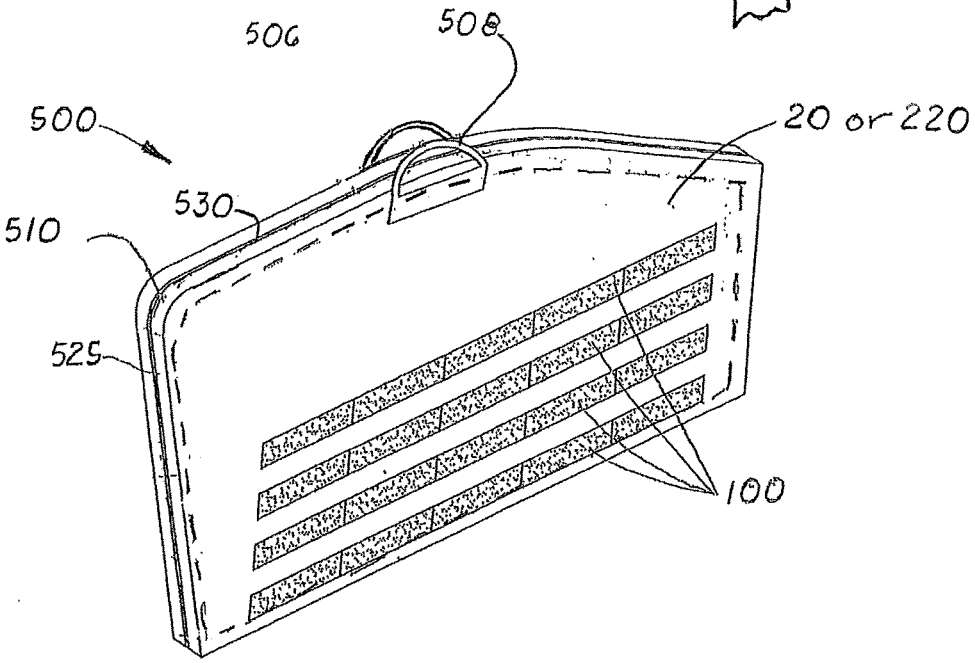
FIG. 30 is a perspective view of a carrying case with a transparent panel located inside the carrying case.

FIG. 30 is a perspective view of a carrying case 500 with a transparent panel 20 or 220 located inside the carrying case 500. The carrying case 500 includes one or two handles 506, 508, two leaves 510, 525 connected by a slide connector 530. The carrying case 500 is enough in size and shape to hold the transparent panel 20 or 220.

The system 10 also includes a ballistic fabric panel 600 configured to hang vertically over the inside surface of the door 4. The ballistic fabric panel 600 has a suitable shape and size so when hung along the inside surface of the door 4, the legs and lower torso of the driver or passenger are protected when sitting in the patrol vehicle 1. As shown in FIG. 29, the ballistic fabric panel 600 is stored inside a pocket 550 formed on a carrying case 500 that hangs vertically over the inside surface of the door 54. The carrying case 500 includes connectors or eyelets 502, 504 that attaches to connectors 380, 390 on the lower bracket 42 used on the mounting mechanism 25 as shown in FIG. 24.

Figure 31:
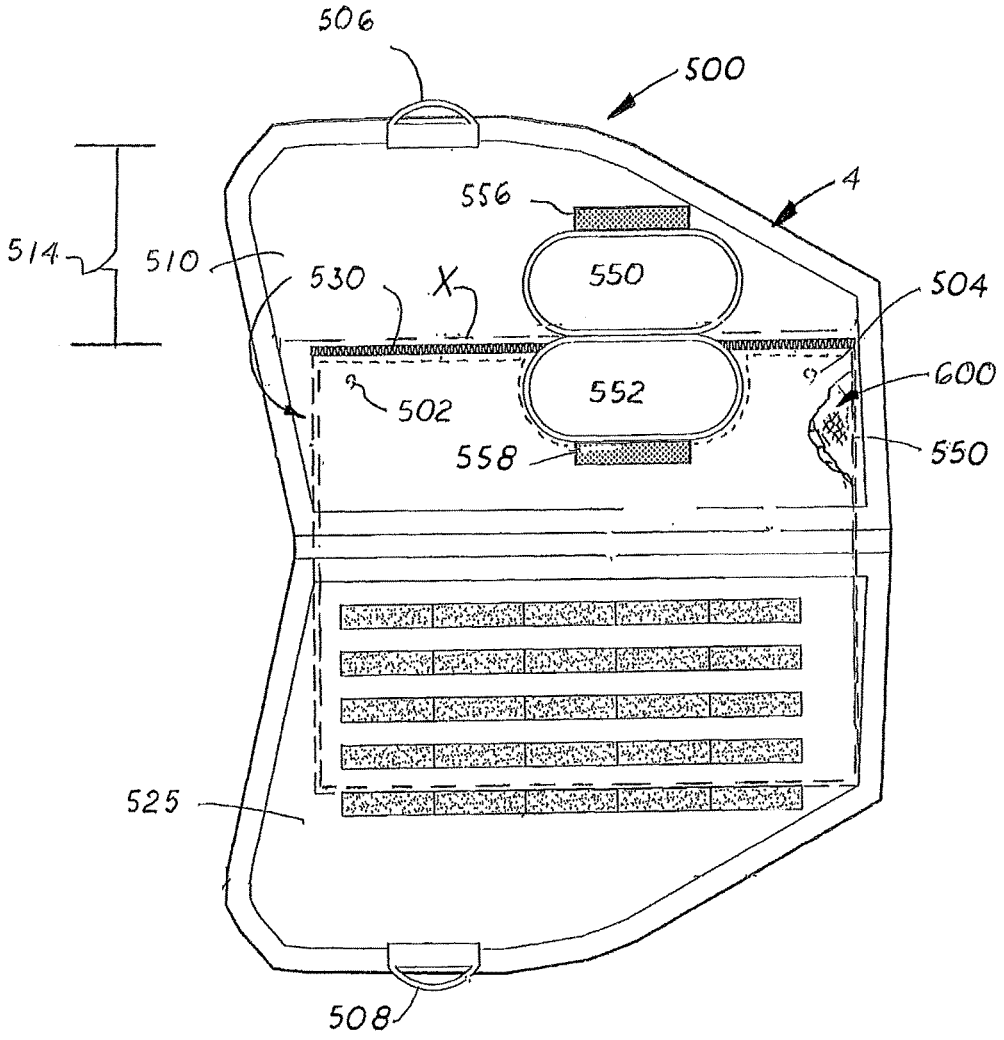
FIG. 31 is a side elevational view of the carrying case in an open configuration with a ballistic fabric panel disposed inside a pocket formed in the carrying case.
Figure 32:
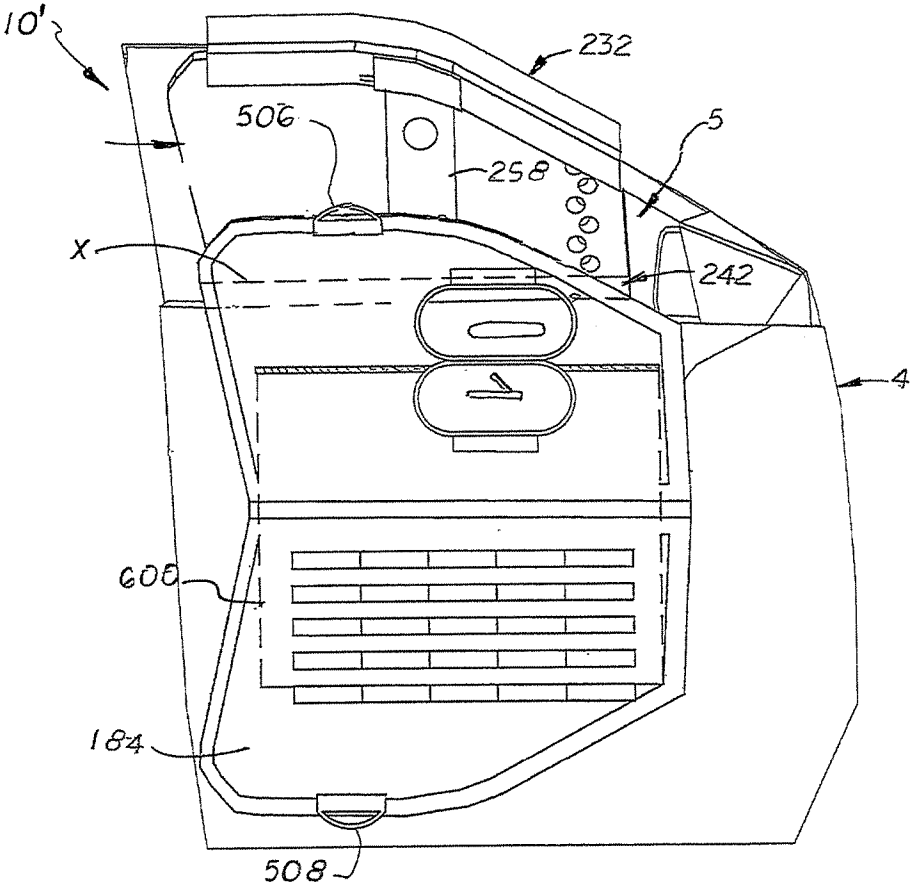
FIG. 32 is a side elevational view of a front door of a patrol vehicle showing the transparent panel, the mounting mechanism and a carrying case attached to the patrol vehicle.

FIG. 31 is a side elevational view of the carrying case 500 in an open configuration with a ballistic fabric panel 600 disposed inside a pocket 550 formed in the carrying case 500. Formed on the carrying case 500, is a handle opening 551, and handle opening cover flap 552. During use, the handle opening 551, is exposed as flap 552 falls against the interior of the door. The flap 552 allows access thru 551 for the driver to grasp the door handle or window up/down switch. Above and below the upper and lower handle opening 551, and the flap 552 are hook and loop connector strips 556, 558, respectively. When attaching the carrying case 500 to the door 4, the upper section 514 of the upper leaf 510 is folded inward along a fold line 'X' shown in FIG. 31. The connectors 502, 504 are then attached to the connectors 380, 390, respectively, to hold the carrying case 500 over the inside surface of the door 4. FIG. 32 is a side elevational view of a front door of a patrol vehicle showing the transparent panel 220, the mounting mechanism 25 and a carrying case 500 attached to the door 2 on a patrol vehicle.

The ballistic fabric panel 600 is made of synthetic fiber sold under the trademark Kelvar (E.I. du Pont de Nemours and Company) and may be obtained from ArmorCo located at Ashtabula, Ohio.

The magnets that hold the transparent panel 20, 220 onto the brackets are configured to release the transparent panel 20, 220 from the brackets when the patrol vehicle experiences a rapid lateral change in velocity. For example, any force that accelerates the patrol vehicle laterally more than over 3 mph in under 200 milliseconds.

When installed on the mounting mechanism 25, the transparent panel 20, 220 protects the driver and passengers from bullets shot into the door 4 or the door window opening 5. When the driver 300 must leave the patrol vehicle 1 and wants personal protection, the transparent panel 20, 220 may be removed from the mounting mechanism 25 and held in front of the driver using the handle 400 as shown in FIG. 2.

Figure 33:
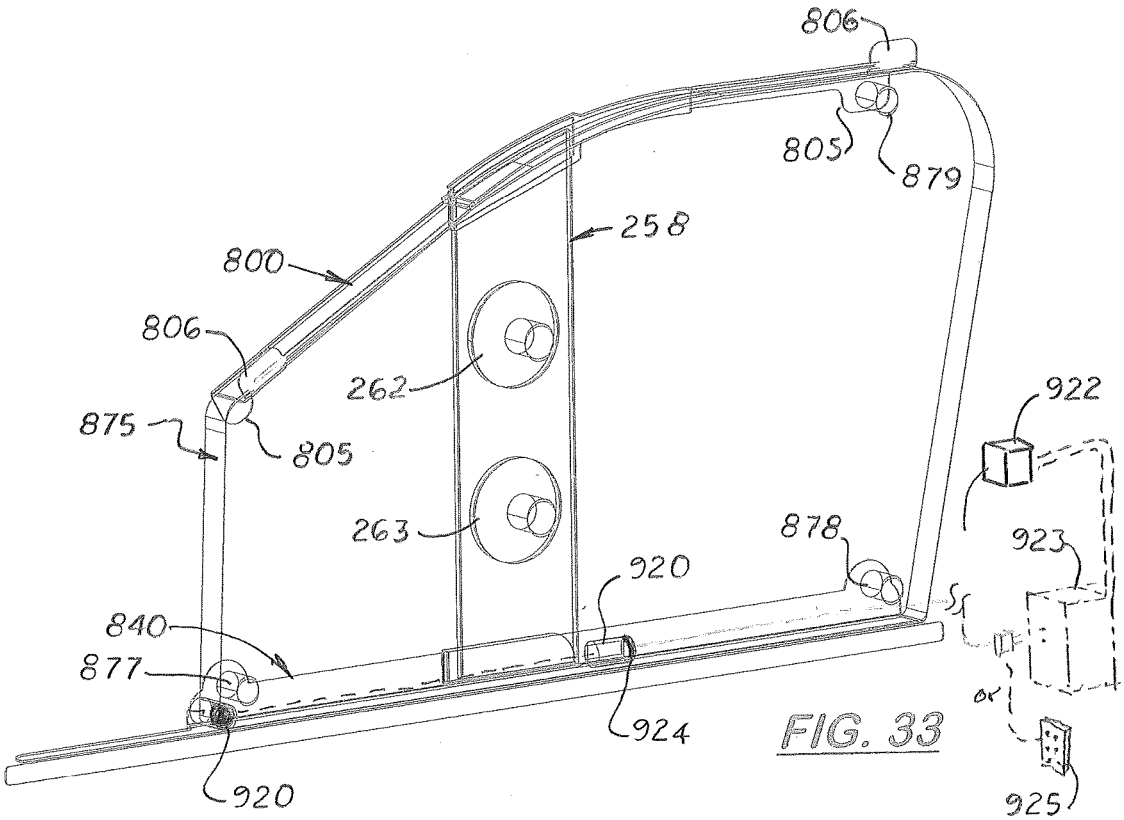
FIG. 33 is an inside perspective view of a third embodiment of the patrol vehicle protection system in a configuration for installment on the right side front door window on a patrol vehicle which shows a pyrotechnic device attached to the lower bracket
Figure 34:
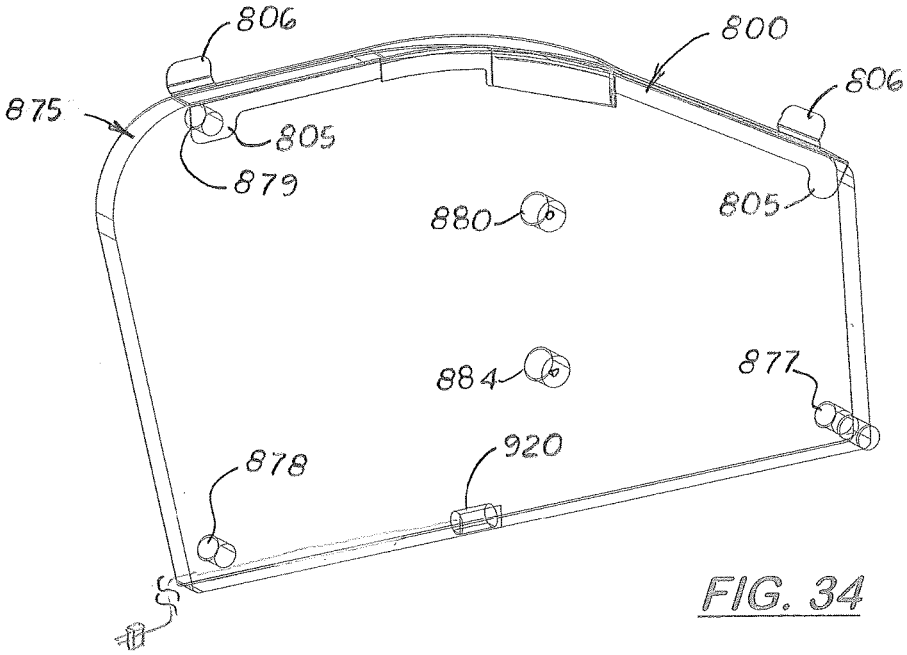
FIG. 34 is an outside perspective view of a third embodiment of the patrol vehicle protection system shown in FIG.
Figure 35:
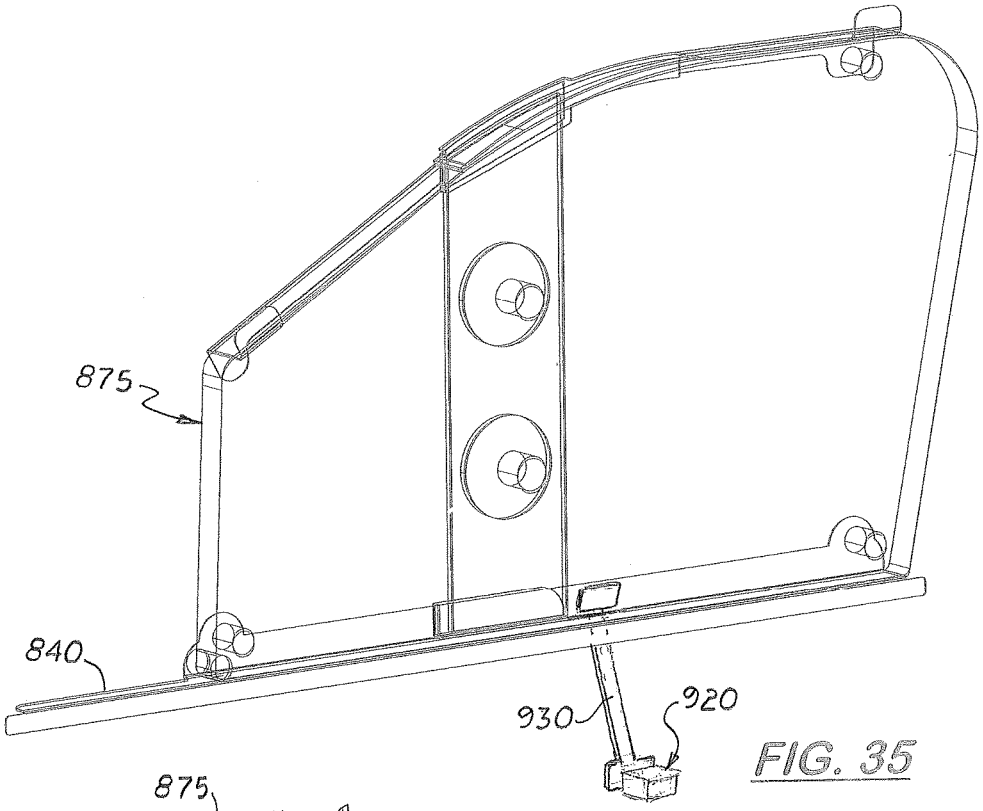
FIG. 35 is an outside perspective view of the patrol vehicle protection system shown in FIG. 33 that uses a mechanical lever arm mounted on the lower bracket that rotates to push the lower edge of the transparent panel outward when pyrotechnic device located inside the door is activated.

FIG. 33 is an inside perspective view of a third embodiment of the patrol vehicle protection system 10 a configuration for installment on the right side front door window opening 5 on a patrol vehicle. The system 10 uses a modified upper bracket 800, a modified lower bracket 840 and a modified transparent panel 875, and an optional fixed length vertical brace 58.

Figure 38:
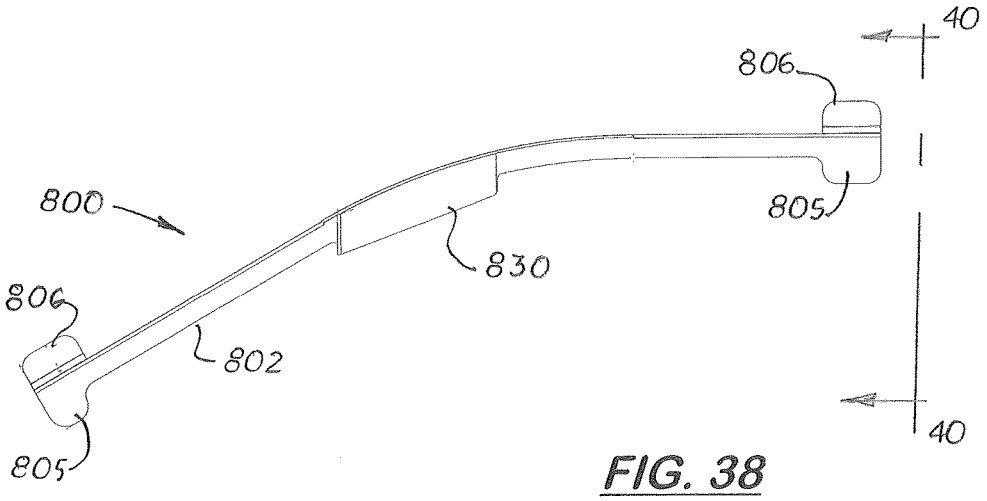
FIG. 38 is a side elevational view of the upper bracket used in the system shown in FIGS. 33 and 35.
Figure 39:
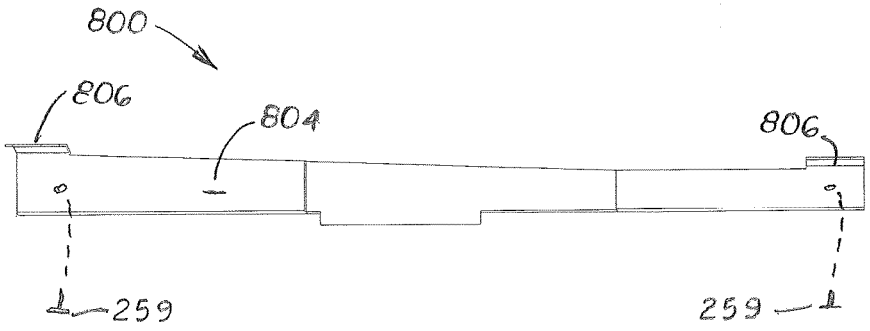
FIG. 39 is a top plan view of the upper bracket shown in FIGS. 33 and 35.
Figure 40:
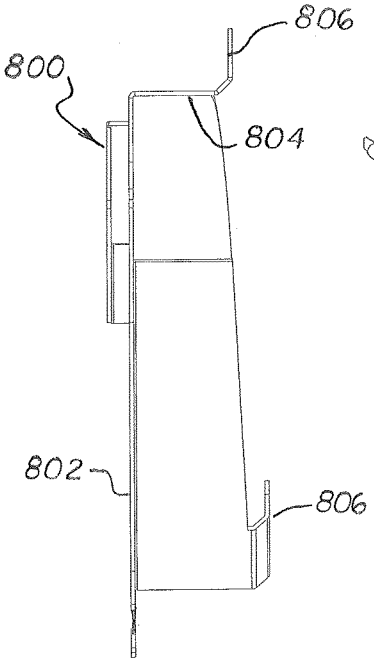
FIG. 40 is an elevational view taken along line 40-40 in FIG. 38.

The upper bracket 800 shown in FIGS. 38-40 is Z-shaped in cross-section with an inner flange surface 802, an intermediate flange surface 804 and two upward extending tabs 806. The intermediate flange surface 804 includes two wide end sections 804 designed to extend downward over the inside surface of the transparent panel 875. The two tabs 806 are configured to be inserted into the upper window track 6 formed on the upper door frame surrounding the door window opening 5.

Figure 41:
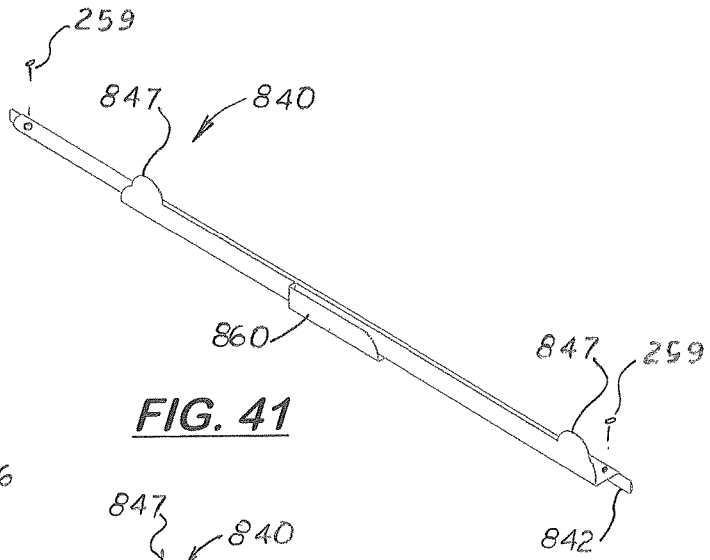
FIG. 41 is a top perspective view of the lower bracket used in the system shown in FIGS. 33 and 35.
Figure 44:
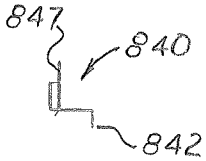
FIG. 44 is an end elevational view of lower bracket shown in FIG. 41
Figure 42:
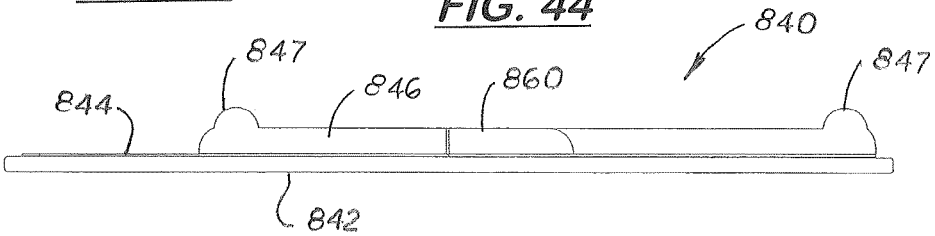
FIG. 42 is a side elevational view of the lower bracket used in the system shown in FIGS. 33 and 34.
Figure 43:
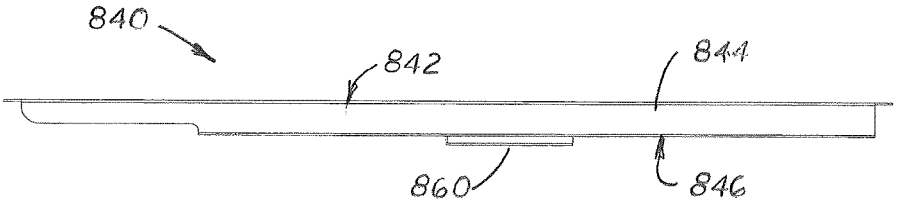
FIG. 43 is a top plan view of the lower bracket shown in FIG. 41.

The lower bracket 840, shown in FIGS. 41-43 is also Z-shaped in cross-section and includes an outer flange surface 842, an intermediate flange surface 844 and an inner flange surface 846. The inner flange surface 846 includes two wide upward extending sections 847 configured to extend over the inside surface of the transparent panel 875. During assembly, the outer flange surface 842 is configured to be inserted into the lower window track 8 formed on the lower inside edge of the existing door window opening 5.

Formed on the inside surface of the upper and lower brackets 800, 820 is an optional slotted receiver 830, 860 which received the opposite ends of a vertical brace 258 when used shown in FIG. 33. Like the embodiments described above, the vertical brace 258 is preferably made of polycarbonate or plastic. One or two holes 262, 263 are formed in the vertical brace 258 that make the vertical brace 258 more flexible and created fracture points in the event the driver or passenger impacts the vertical brace 258.

The transparent panel 875 is similar to the modified transparent panel 20' discussed above. The length of the transparent panel 875 is smaller than the window opening thereby created a small window opening for ventilation. Attached or mounted on the corners of the transparent panel 875 are at least three magnets 877, 878, 879 configured to be magnetically attracted to the upper and lower brackets, 800, 840. The upper and lower brackets 800, 840 may be made of steel that is magnetically attractive to the magnets or may include steel discs or a second set of magnets may be attached to the brackets that are magnetically attractive to magnets 877, 878, 879 attached to the transparent panel 875. In every configuration, the magnets 877, 878, 879 configured to hold the transparent panel 875 onto the brackets 800, 840 and only release the transparent panel 220 from the brackets 800, 840 when the patrol vehicle experiences a rapid lateral change in velocity.

Figure 47:
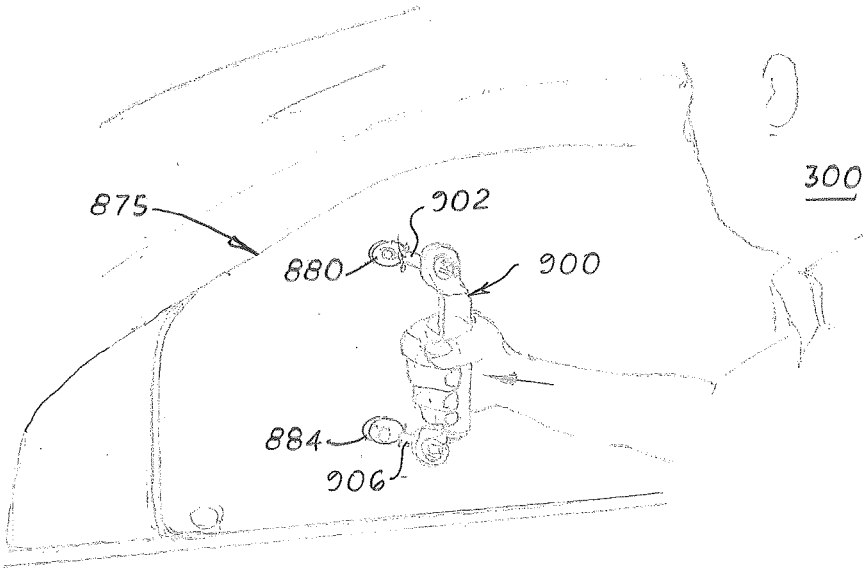
FIG. 47 is an illustration showing a patrol officer selectively attaching the handle to the transparent panel.
Figure 48:
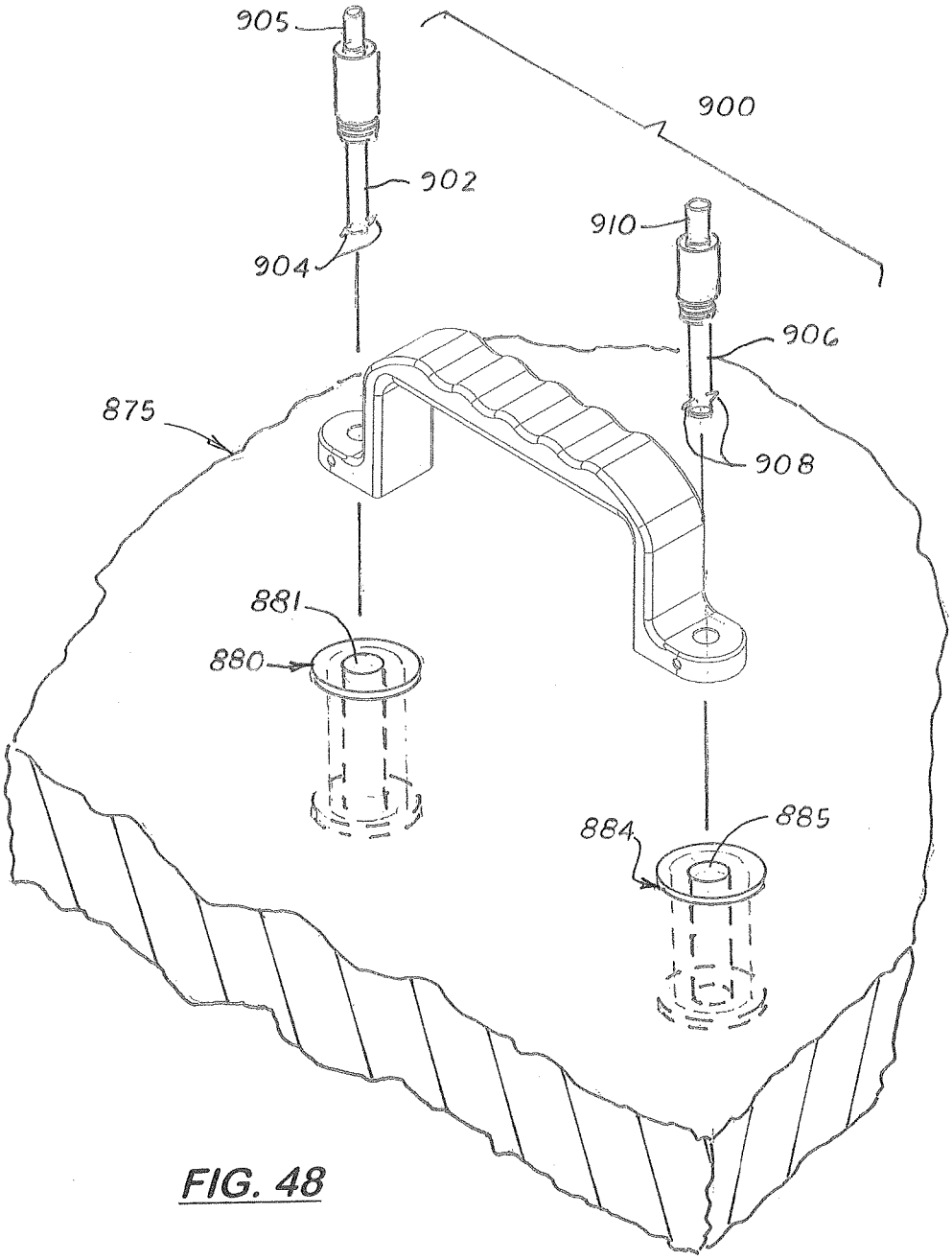
FIG. 48 is an exploded view of a section of the transparent panel with two hole adapters inserted into the transparent panel and showing a handle with two quick release, push release buttons being inserted into bores formed in the hole adapters.
Figure 49:
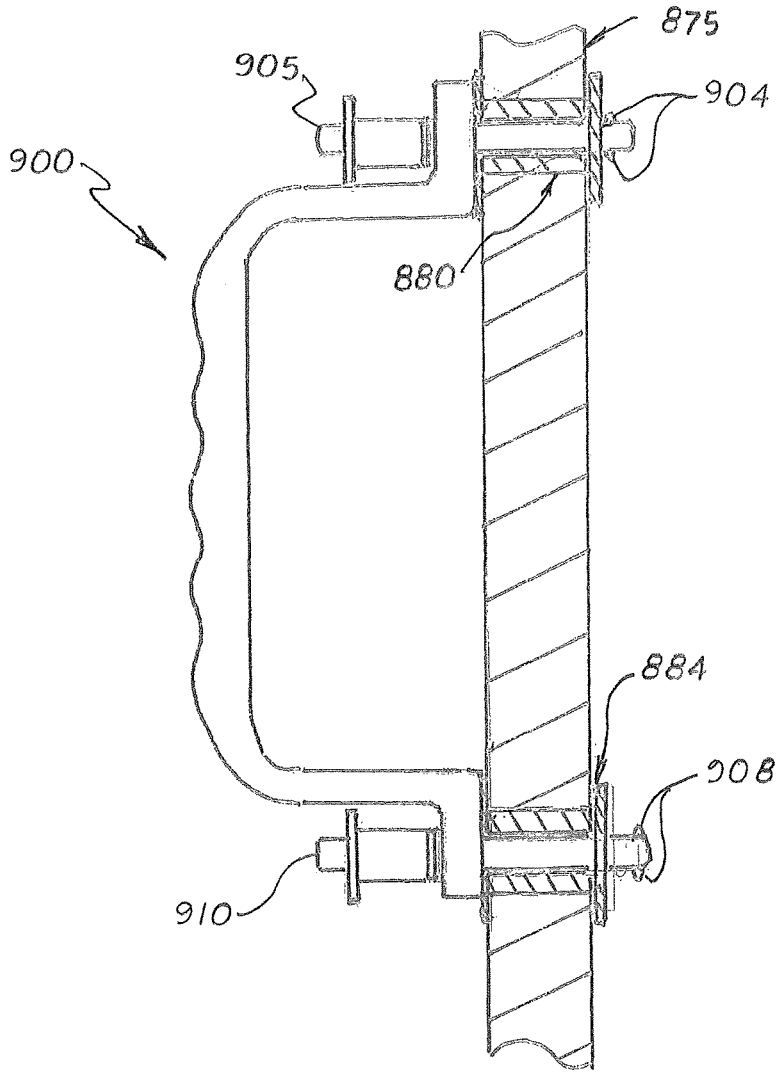
FIG. 49 is a sectional view of the transparent panel with a handle with push release buttons attached to the two holes formed on the transparent panel.

Formed on the transparent panel 875 are two transversely aligned, imbedded handle adapters 880, 884 each with axially aligned bores 881, 885, respectively. Included with the system, is an optional quick connect and quick release handle 900 configured to selectively connect to the transparent panel 875. As shown in FIG. 48, the handle 900 includes two perpendicularly aligned pegs 902, 906. Attached to the distal end of the pegs 902, 906 are outward biased pairs of pins 904, 908 that extend outward and prevent the pegs 902, 906 from disconnecting from the bores 881, 885 when inserted therein. Each peg 902, 906 is connected to a plunger style push release button 905, 910, respectively, that when pressed, causes the two pairs of pins 904, 906, respectively, to retract into the peg 902, 906 hereby allowing the handle 900 to disconnect from the handle adapters 880, 884 and removed from the transparent panel 875. FIG. 47 is an illustration showing a patrol officer attaching the handle 900 to the transparent panel 875 and FIG. 49 is a sectional view of the transparent panel 875 using it as a protective shield.

Figure 36:
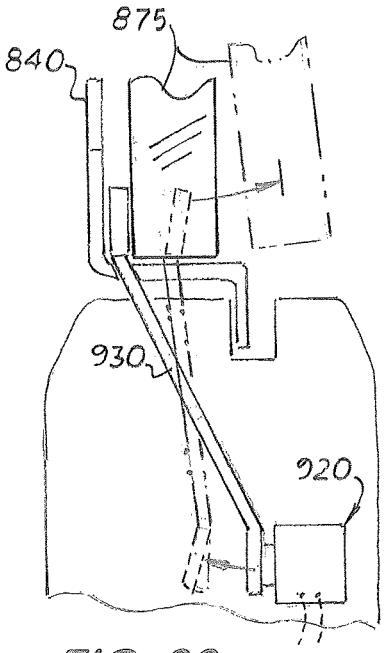
FIG. 36 is a sectional end view of the door showing the relative locations of the lever arm and pyrotechnic device shown in FIG. 35.
Figure 37:
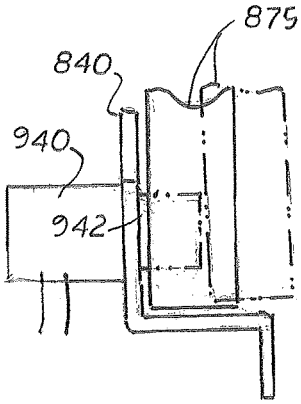
FIG. 37 is an end elevational view of an alternative lateral force generating device that uses a solenoid mounted on the upper flange on the lower bracket that when activated forces a plunger outward against the inside surface of the transparent panel to remove the transparent panel from the door window opening.

Attached or mounted on the intermediate flange surface 846 on the lower bracket 840 is at least one optional lateral force generating device configured to force the transparent panel 875 outward when a lateral force exerted on the patrol vehicle is detected. In one embodiment, the lateral force generating device is at least one pyrotechnic device 920 mounted on the inside surface of the upper flange on the lower bracket. The pyrotechnic device 920 is configured to force the lower edge of the transparent panel 875 outward from the upper and lower brackets 800, 840 when activated. The pyrotechnic device 920 is similar to a pyrotechnic seatbelt tensioner or to a mirror gas generator. Alternatively, the pyrotechnic device 920 may be mounted inside the door and coupled to a lever 930 that forces the lower edge of the transparent panel 875 when the pyrotechnic device 920 is activated as shown in FIG. 36. It should also be understood that the lateral force generating device may be an electrical solenoid 940 with a plunger 942 that when activated, extends the plunger 942 outward to force the lower edge of the transparent panel 875 outward as shown in FIG. 37.

Figure 45:
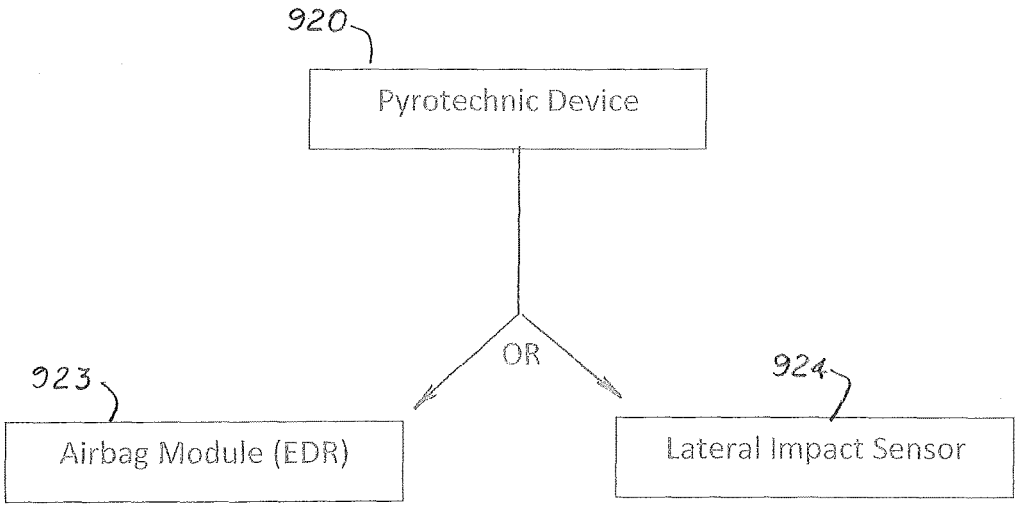
FIG. 45 is a diagram showing the pyrotechnic device attached to an airbag module or a lateral impact sensor.

The pyrotechnic device 920 or solenoid 940 may include a built-in sensor or coupled to a separately located sensor 922 configured to detect a lateral impact force on the patrol vehicle. As shown in FIG. 45, the sensor 922 may be the patrol vehicle's airbag module 923 or a separate lateral sensor 924 connected to the module 923 or to the patrol vehicle's OBDII port 925. The pyrotechnic device 920 or solenoid 940 may be held on the lower bracket 840 with adhesive tape, hook and loop pads, or with a metal clip. It should be noted that although one pyrotechnic device 920 (as shown in FIG. 33) is used on the lower bracket 840, it may be used on the upper bracket 800 and lateral force generative devices may be attached to one or both brackets 800, 840.

To install the system 10 on a door window opening 5 on a patrol vehicle, the window is first rolled down. Next, the lower bracket 840 is attached to the lower window track 8. Next, the upper bracket 800 is inserted into the upper window track 6. If the upper and lower brackets 800, 840 are not affixed to the door frame, the vertical brace 258 must be vertically aligned between the upper and lower vertical braces 800, 840 so that its opposite ends slide into the receiver slots 237, 247. When the vertical brace 258 is not desired, threaded connectors 259 are used to hold the upper bracket 800 and the lower bracket 840 on the door frame.

After the upper bracket 800 and the lower bracket 840 are secured over the door window opening 5, the transparent panel 875 is then inserted over the opening formed between the upper and lower brackets 800, 840. The patrol vehicle's window can then be rolled up.

Figure 46:
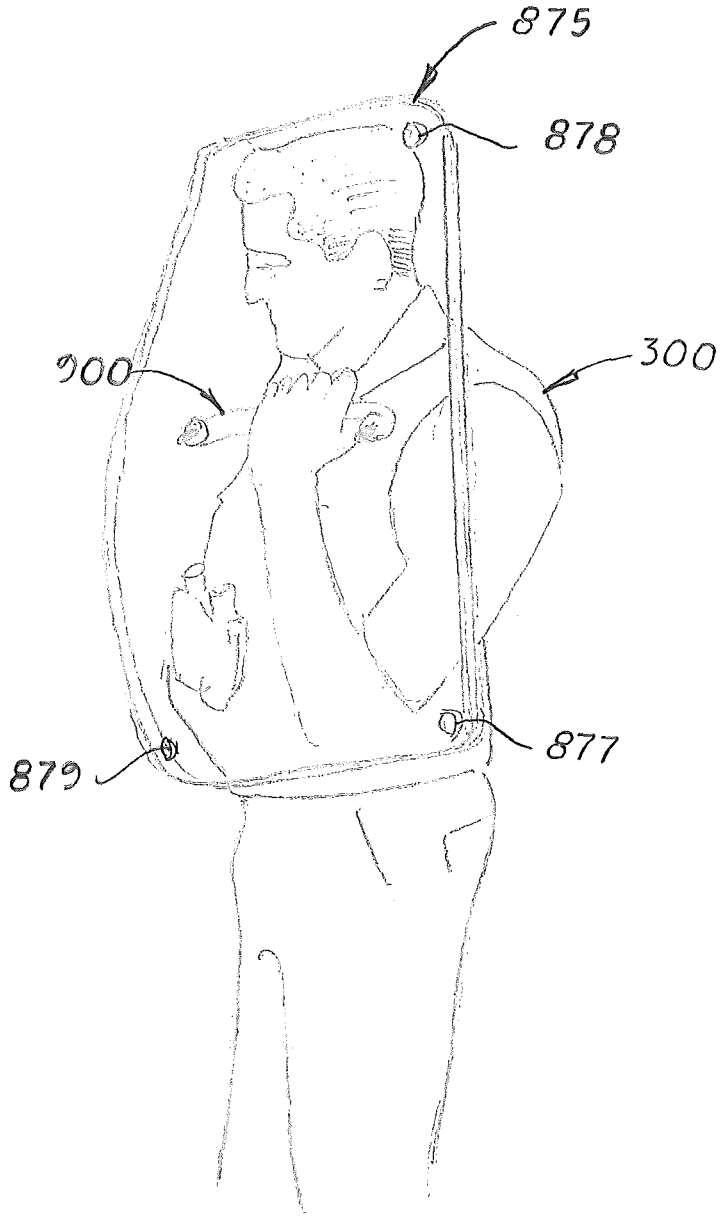
FIG. 46 is an illustration showing a patrol officer holding and using the transparent panel as a protective shield

When the patrol officer desires to use the transparent panel 875 as a body shield, the window is rolled down. The handle 900 is then selected and aligned over the outside surface of the transparent panel 875 so that the pegs 902, 906 may be forced into the bores 881, 885 formed on the handle adapters 880, 884. The patrol officer then presses the handle 900 into the bores 881, 885 formed on the handle adapters 880, 884 until the pins 904, 908 attached to the pegs 902, 906 fully extend on the inside surface of the transparent panel 875. The handle 900 is now locked onto the transparent panel 875. The patrol officer then pulls on the handle 900 to remove the transparent panel 875 from the door window opening 5. The patrol officer holds the transparent panel 875 so the his or her head and upper torso are protected as shown in FIG. 46.

In compliance with the statute, the invention described has been described in language more or less specific on structural features. It should be understood, however, that the invention is not limited to the specific features shown, since the means and construction shown comprises the preferred embodiments for putting the invention into effect. The invention is therefore claimed in its forms or modifications within the legitimate and valid scope of the amended claims, appropriately interpreted the doctrine of equivalents.

We claim:

1. A patrol vehicle protection system, comprising:

a. a mounting mechanism that selectively holds a transparent panel to cover a door window opening on a patrol vehicle, said mounting mechanism includes an upper bracket and a lower bracket, said upper bracket configured to engage an upper window track formed around said door window opening, said lower bracket configured to engage a lower window track around said door window opening;

b. a transparent panel configured to fit inside said door window opening and supported by said upper bracket and said lower bracket when installed in said door window opening, said transparent panel made of ballistic-rated material and has a shape and thickness that prevent a ballistic object from penetrating said door window opening;

c. connecting elements disposed between said upper bracket and said transparent panel and between said lower bracket and said transparent panel, said connecting elements produce enough force to hold said transparent panel against said upper bracket and said lower bracket when driving said patrol vehicle but enable said transparent panel to release outward from said mounting mechanism when a lateral side impact force is applied to said patrol vehicle; and d. a lateral force generating device configured to force said transparent panel outward from said door window opening when excessive lateral force is exerted on said patrol vehicle.

2. The patrol vehicle protection system, as recited in claim 1, further including an external handle configured to be selectively attached to said transparent panel.

3. The patrol vehicle protection system, as recited in claim 1, further including a case configured to carry said transparent panel.

4. The patrol vehicle protection system, as recited in claim 1, further including a vertical brace extending between said upper brace and said lower brace.

5. The patrol vehicle protection system, as recited in claim 4, wherein said vertical brace is adjustable in length.

6. The patrol vehicle protection system, as recited in claim 1, wherein said connecting elements are a plurality of magnets located on the inside surface of said transparent panel magnetically attracted to said upper bracket and said lower bracket.

7. The patrol vehicle protection system, as recited in claim 1, wherein said connecting elements are hook and loop connectors located in an inside surface of said transparent panel and said upper bracket and said lower bracket configured to hold said transparent panel on said upper bracket and said lower bracket.

8. The patrol vehicle protection system, as recited in claim 1, wherein said connecting elements are rotating tabs mounted on said upper bracket and said lower bracket configured to hold said transparent panel against said upper bracket and said lower bracket.

9. The patrol vehicle protection system, as recited in claim 1, wherein said lateral force generating device is coupled to a sensor configured to detect a lateral force exerted on said patrol vehicle.

10. The patrol vehicle protection system, as recited in claim 1, wherein said lateral force generating device is mounted on the lower bracket.

11. The patrol vehicle protection system, as recited in claim 1, wherein said lateral force generating device is a pyrotechnic device.

12. The patrol vehicle protection system, as recited in claim 9, wherein said sensor is the motor vehicle's air bag sensor.

13. The patrol vehicle protection system as recited in claim 10, further including a sensor connected to said pyrotechnic device configured to detect vehicle side impacts.

14. An improved patrol vehicle protection system that includes a transparent panel made of anti-ballistic material that fits into a door window opening on a patrol vehicle, the improvement comprising;

a. a mounting mechanism on said patrol vehicle that selectively holds said transparent panel over said door window opening, said mounting mechanism includes an upper bracket, a lower bracket, said upper bracket configured to be inserted into an upper window track formed along said window opening, said lower bracket configured to be inserted into a lower window track of said door window opening;

b. a plurality of connecting elements disposed on said upper bracket and on said lower bracket configured to attached to said transparent panel when placed into said door window opening, said connecting elements produce a sufficient force to hold said transparent panel against said mounting mechanism and inside said door window opening when driving said patrol vehicle but releases said transparent panel outward from said mounting mechanism when a lateral side impact force is applied to said patrol vehicle; and c. a handle selectively attached to said transparent handle.

15. The patrol vehicle protection system, as recited in claim 14, wherein said connecting elements are a plurality of magnets.

16. The patrol vehicle protection system, as recited in claim 14, wherein said connecting elements are hook or loop connectors.

17. The patrol vehicle protection system, as recited in claim 14, further including a lateral generating device located on upper bracket or said lower bracket configured to force said transparent panel outward from said upper or lower bracket when activated, said lateral generating device being attached to a sensor that senses lateral movement of said motor vehicle.

18. The patrol vehicle protection system, as recited in claim 17, wherein said lateral generating force device is a pyrotechnic device.

19. The patrol vehicle protection system, as recited in claim 15, wherein said patrol vehicle includes an airbag control module and said lateral force generating device is a pyrotechnic device mounted on said upper bracket or said lower bracket and configured to force said transparent panel outward from said upper or lower bracket when an activation signal is sent from said airbag control module to said pyrotechnic device.

* * * * *